US007999770B2

(12) United States Patent
Kasai

(10) Patent No.: US 7,999,770 B2
(45) Date of Patent: Aug. 16, 2011

(54) ELECTRO-OPTICAL DEVICE, METHOD OF DRIVING ELECTRO-OPTICAL DEVICE, AND ELECTRONIC APPARATUS

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 1017 days.

(21) Appl. No.: 11/826,287

(22) Filed: Jul. 13, 2007

(65) Prior Publication Data

US 2007/0257868 A1 Nov. 8, 2007

Related U.S. Application Data

(63) Continuation of application No. 10/724,263, filed on Dec. 1, 2003, now Pat. No. 7,259,735.

(30) Foreign Application Priority Data

Dec. 12, 2002 (JP) ..... 2002-360978

(51) Int. Cl.
*G09G 3/30* (2006.01)

(52) U.S. Cl. ..... 345/77

(58) Field of Classification Search ..... None
See application file for complete search history.

(56) References Cited

U.S. PATENT DOCUMENTS

| | | | | |
|---|---|---|---|---|
| 6,011,529 | A | 1/2000 | Ikeda | |
| 6,246,180 | B1 | 6/2001 | Nishigaki | |
| 6,583,775 | B1 * | 6/2003 | Sekiya et al. | 345/76 |
| 2002/0015104 | A1 | 2/2002 | Itoh et al. | |
| 2002/0130828 | A1 | 9/2002 | Yamazaki et al. | |
| 2005/0041002 | A1 | 2/2005 | Takahara et al. | |

FOREIGN PATENT DOCUMENTS

| | | |
|---|---|---|
| CN | A 1278635 | 1/2001 |
| EP | A 1 061 497 | 12/2000 |
| EP | A 1 091 341 | 4/2001 |
| EP | A 1 102 234 | 5/2001 |
| JP | A 2000-221942 | 8/2000 |
| JP | A 2001-60076 | 3/2001 |
| JP | A 2001-147659 | 5/2001 |
| JP | A 2002-156950 | 5/2002 |
| JP | A 2003-216100 | 7/2003 |
| KR | 2000-0071301 | 11/2000 |
| WO | WO 98/48403 | 10/1998 |
| WO | WO 03/023750 | 3/2003 |

OTHER PUBLICATIONS

Office Action issued in U.S. Appl. No. 11/826,282 on Feb. 15, 2011.
Sep. 21, 2010 Office Action issued in U.S. Appl. No. 11/826,282.

* cited by examiner

*Primary Examiner* — Sumati Lefkowitz
*Assistant Examiner* — Tammy Pham
(74) *Attorney, Agent, or Firm* — Oliff & Berridge, PLC

(57) ABSTRACT

The present invention provides a technique to improve the display quality of an electro-optical device using an electro-optical element which emits light with a brightness corresponding to a driving current. Each pixel can include an organic EL element OLED which emits light with a brightness corresponding to a driving current, a capacitor for storing an electric charge corresponding to data supplied via a data line, a drive transistor for setting a driving current according to the electric charge stored in the capacitor and for supplying the set driving current to the organic EL element OLED, and a control transistor which repeats interruption of a current path for the driving current in one vertical scanning period.

15 Claims, 15 Drawing Sheets

ELECTRO-OPTICAL DEVICE, METHOD OF DRIVING ELECTRO-OPTICAL DEVICE, AND ELECTRONIC APPARATUS

This is a Continuation of application Ser. No. 10/724,263 filed Dec. 1, 2003. The disclosure of the prior application is hereby incorporated by reference herein in its entirety.

BACKGROUND OF THE INVENTION

1. Field of Invention

The present invention relates to an electro-optical device using an electro-optical element whose brightness is controlled by a current, a method of driving the electro-optical device, and an electronic apparatus. More particularly, the present invention relates to a technology for interrupting a current path for a driving current.

2. Description of Related Art

Recently, flat panel displays (FPDs) using organic EL (electroluminescence) elements are of high interest. An organic EL element is a typical current-driven element which is driven by a current flowing therein, and emits light with a brightness corresponding to the current level. Driving methods for active-matrix displays using organic EL elements are roughly grouped into a voltage-programmed type and a current-programmed type.

As an example, Japanese Unexamined Patent Application Publication No. 2001-60076 discloses a voltage-programmed pixel circuit having a transistor (TFT3 shown in FIG. 5 of this document) in a current path for supplying a driving current to an organic EL element so as to interrupt the path. The transistor is turned on in the first half of one frame period, and is turned off in the last half thereof. Thus, for the first half period in which the transistor is turned on to let the driving current flow, the organic EL element emits light with a brightness corresponding to the current level. For the last half period in which the transistor is turned off to interrupt the driving current, the organic EL element is forcibly extinguished and is displayed as black. This technique is called blinking, and the blinking technique allows an after image left in the human eye to be stopped, thus improving the display quality of moving pictures.

As other examples, Japanese Unexamined Patent Application Publication No. 2001-147659 and Japanese Unexamined Patent Application Publication No. 2002-514320 disclose current-programmed pixel circuit structures. Japanese Unexamined Patent Application Publication No. 2001-147659 refers to a pixel circuit using a current mirror circuit formed of a pair of transistors. Japanese Unexamined Patent Application Publication No. 2002-514320 refers to a pixel circuit that reduces current nonuniformity and threshold voltage variations in drive transistors as sources that set the driving current supplied to organic EL elements.

SUMMARY OF THE INVENTION

Accordingly, an object of the present invention is to provide an electro-optical device using an electro-optical element which emits light with a brightness corresponding to a driving current in which the display quality is improved.

In order to overcome such problems, a first aspect of the invention provides an electro-optical device that can include a plurality of scanning lines, a plurality of data lines, a plurality of pixels located at intersections of the scanning lines and the data lines, a scanning-line driving circuit for outputting a scanning signal to the scanning lines so as to select the scanning line corresponding to a pixel to which data is written, and a data-line driving circuit cooperating with the scanning-line driving circuit for outputting data to the data line corresponding to the pixel to which data is written. Each pixel can include an electro-optical element for emitting light with a brightness corresponding to a driving current, a capacitor for storing an electric charge corresponding to the data supplied via the data line to write the data, a drive transistor, and a control transistor. The drive transistor sets the driving current according to the electric charge stored in the capacitor, and supplies the set driving current to the electro-optical element. The control transistor repeatedly interrupts the current path for the driving current for a period after the scanning line corresponding to the pixel to which data is written until the next time this scanning line is selected.

The first aspect of the invention may be applied to a current-programmed type. If the current-programmed type is used, the data-line driving circuit outputs data serving as a data current to the data line. Each pixel further includes a programming transistor. The programming transistor generates a gate voltage by causing the data current to flow in its channel. An electric charge corresponding to the generated gate voltage is stored in the capacitor, thereby writing data to the capacitor. The first aspect of the invention may also be applied to a voltage-programmed type. In the voltage-programmed type, the data-line driving circuit outputs data serving as a data voltage to the data line. Data writing to the capacitor is performed according to the data voltage.

In the first aspect of the invention, preferably, the control transistor is turned on or off under the control of a pulse signal output from the scanning-line driving circuit. In this case, preferably, the scanning-line driving circuit converts the pulse signal supplied to the pixel to which data is written to a signal with pulse form which alternates between a high level and a low level in synchronization with the scanning signal supplied to the pixel to which data is written.

A second aspect of the invention provides an electro-optical device that can include a plurality of scanning lines, a plurality of data lines, a plurality of pixels located at intersections of the scanning lines and the data lines, a scanning-line driving circuit for outputting a first scanning signal to the scanning lines so as to select the scanning line corresponding to a pixel to which data is written and for outputting a second scanning signal synchronous with the first scanning signal and a pulse signal synchronous with the first scanning signal, and a data-line driving circuit cooperating with the scanning-line driving circuit for outputting a data current to the data line corresponding to the pixel to which data is written. Each pixel includes five transistors, a capacitor, and an electro-optical element. A first switching transistor has one of a source terminal and a drain terminal connected with the data line so as to be controlled by the first scanning signal. A second switching transistor has one of a source terminal and a drain terminal connected with the other terminal of the first switching transistor so as to be controlled by the second scanning signal. The capacitor is connected with the other terminal of the second switching transistor. A programming transistor has a drain commonly connected with the other terminal of the first switching transistor and the one terminal of the second switching transistor, and a gate commonly connected with the other terminal of the second switching transistor and the capacitor, so that an electric charge corresponding to the data current is stored in the capacitor connected with the gate of this programming transistor. A drive transistor is paired with the programming transistor to form a current mirror circuit, and sets a driving current according to the electric charge stored in the capacitor, which is connected with a gate thereof.

The electro-optical element emits light with a brightness corresponding to the driving current. A control transistor is provided in the current path for the driving current, and interrupts the current path for the driving current under conduction control of the pulse signal.

In the second aspect of the invention, preferably, the control transistor repeatedly interrupts the current path for the driving current for a period after the scanning line corresponding to the pixel to which data is written until the next time this scanning line is selected. In this case, preferably, the control transistor continues to interrupt the current path for the driving current for a programming period in the period after the scanning line corresponding to the pixel to which data is written until the next time this scanning line is selected, and repeatedly interrupts the current path for the driving current for a driving period subsequent to the programming period.

In the second aspect of the invention, in view of prevention of leakage current of the drive transistor, the control transistor may interrupt the current path for the driving current for a programming period in the period after the scanning line corresponding to the pixel to which data is written is selected until the next time this scanning line is selected, and may not interrupt the current path for the driving current for a driving period subsequent to the programming period.

A third aspect of the invention provides an electro-optical device including a plurality of scanning lines; a plurality of data lines; a plurality of pixels located at intersections of the scanning lines and the data lines; a scanning-line driving circuit for outputting a scanning signal to the scanning lines so as to select the scanning line corresponding to a pixel to which data is written, and for outputting a pulse signal synchronous with the scanning signal; and a data-line driving circuit cooperating with the scanning-line driving circuit for outputting a data current to the data line corresponding to the pixel to which data is written. Each pixel includes four transistors, a capacitor, and an electro-optical element. A first switching transistor has one of a source terminal and a drain terminal connected with the data line so as to be controlled by the scanning signal. A second switching transistor is controlled by the scanning signal. The capacitor is connected between the other terminal of the first switching transistor and one terminal of the second switching transistor. A drive transistor has a source connected with the other terminal of the first switching transistor, a gate connected with the one terminal of the second switching transistor, and a drain connected with the other terminal of the second switching transistor. The drive transistor stores an electric charge corresponding to the data current in the capacitor, which is connected between the gate and source of the drive transistor, and sets a driving current according to the electric charge stored in the capacitor. The electro-optical element emits light with a brightness corresponding to the driving current. A control transistor repeatedly interrupts the current path for the driving current under conduction control of the pulse signal for a period after the scanning line corresponding to the pixel to which data is written is selected until the next time this scanning line is selected.

In the third aspect of the invention, preferably, the control transistor continues to interrupt the current path for the driving current for a programming period in the period after the scanning line corresponding to the pixel to which data is written is selected until the next time this scanning line is selected, and repeatedly interrupts the current path for the driving current for a driving period subsequent to the programming period.

A fourth aspect of the invention provides an electro-optical device that can include a plurality of scanning lines, a plurality of data lines, a plurality of pixels located at intersection of the scanning lines and the data lines, a scanning-line driving circuit for outputting a scanning signal to the scanning lines so as to select the scanning line corresponding to a pixel to which data is written and for outputting a pulse signal synchronous with the scanning signal, and a data-line driving circuit cooperating with the scanning-line driving circuit for outputting a data current to the data line corresponding to the pixel to which data is written. Each pixel can include four transistors, a capacitor, and an electro-optical element. A first switching transistor has one of a source terminal and a drain terminal connected with the data line so as to be controlled by the scanning signal. A second switching transistor has one of a source terminal and a drain terminal connected with the other terminal of the first switching transistor so as to be controlled by the scanning signal. The capacitor is connected with the other terminal of the second switching transistor. A drive transistor has a gate commonly connected with the other terminal of the second switching transistor and the capacitor, and a drain commonly connected with the other terminal of the first switching transistor and the one terminal of the second switching transistor. The drive transistor stores an electric charge corresponding to the data current in the capacitor, which is connected with the gate of the drive transistor, and sets a driving current according to the electric charge stored in the capacitor. The electro-optical element emits light with a brightness corresponding to the driving current. A control transistor repeatedly interrupts the current path for the driving current under conduction control of the pulse signal for a period after the scanning line corresponding to the pixel to which data is written is selected until the next time this scanning line is selected.

In the fourth aspect of the invention, preferably, the control transistor continues to interrupt the current path for the driving current for a programming period in the period after the scanning line corresponding to the pixel to which data is written is selected until the next time this scanning line is selected, and repeatedly interrupts the current path for the driving current for a driving period subsequent to the programming period.

A fifth aspect of the invention provides an electro-optical device that can include a plurality of scanning lines, a plurality of data lines, a plurality of pixels located at intersections of the scanning lines and the data lines, a scanning-line driving circuit for outputting a scanning signal to the scanning lines so as to select the scanning line corresponding to a pixel to which data is written and for outputting a pulse signal synchronous with the scanning signal, and a data-line driving circuit cooperating with the scanning-line driving circuit for outputting a data voltage to the data line corresponding to the pixel to which data is written. Each pixel includes three transistors, a capacitor, and an electro-optical element. A switching transistor has one of a source terminal and a drain terminal connected with the data line so as to be controlled by the scanning signal. The capacitor is connected with the other terminal of the switching transistor, and stores an electric charge corresponding to the data voltage. A drive transistor has a gate commonly connected with the other terminal of the switching transistor and the capacitor, and sets a driving current according to the electric charge stored in the capacitor. The electro-optical element emits light with a brightness corresponding to the driving current. A control transistor repeatedly interrupts the current path for the driving current under conduction control of the pulse signal for a period after the scanning line corresponding to the pixel to which data is written is selected until the next time this scanning line is selected.

In the fifth aspect of the invention, preferably, the control transistor continues to interrupt the current path for the driving current for a first half period of the period after the scanning line corresponding to the pixel to which data is written is selected until the next time this scanning line is selected, and repeatedly interrupts the current path for the driving current for a last half period subsequent to the first half period.

A sixth aspect of the invention provides an electro-optical device that can include a plurality of scanning lines, a plurality of data lines, a plurality of pixels located at intersections of the scanning lines and the data lines, a scanning-line driving circuit for outputting a first scanning signal to the scanning lines so as to select the scanning line corresponding to a pixel to which data is written and for outputting a second scanning signal synchronous with the first scanning signal and a pulse signal synchronous with the first scanning signal, and a data-line driving circuit cooperating with the scanning-line driving circuit for outputting a data voltage to the data line corresponding to the pixel to which data is written. Each pixel includes four transistors, two capacitors, and an electro-optical element. A first switching transistor has one of a source terminal and a drain terminal connected with the data line so as to be controlled by the first scanning signal. A first capacitor has one electrode connected with the other terminal of the first switching transistor, and a second capacitor has one electrode to which a power potential is applied. A second switching transistor has one of a source terminal and a drain terminal commonly connected with the other electrode of the first capacitor and the other electrode of the second capacitor so as to be controlled by the second scanning signal.

A drive transistor has a gate commonly connected with the one terminal of the second switching transistor, the other terminal of the first capacitor, and the other terminal of the second capacitor, a source connected with the one electrode of the second capacitor, and a drain connected with the other terminal of the second switching transistor. The drive transistor stores an electric charge corresponding to the data voltage in the second capacitor, and sets a driving current according to the electric charge stored in the second capacitor. The electro-optical element emits light with a brightness corresponding to the driving current. A control transistor repeatedly interrupts the current path for the driving current under conduction control of the pulse signal for a period after the scanning line corresponding to the pixel to which data is written is selected until the next time this scanning line is selected.

In the sixth aspect of the invention, preferably, the control transistor repeatedly interrupts the current path for the driving current for a driving period in the period after the scanning line corresponding to the pixel to which data is written is selected until the next time this scanning line is selected, and continues to interrupt the current path for the driving current for the period other than the driving period.

A seventh aspect of the invention provides an electronic apparatus including the electro-optical device according to any of the above-described first to sixth aspects of the invention.

An eighth aspect of the invention provides a method of driving an electro-optical device that can include a plurality of pixels located at intersections of scanning lines and data lines, a scanning-line driving circuit for outputting a scanning signal to the scanning lines so as to select the scanning line corresponding to a pixel to which data is written, and a data-line driving circuit cooperating with the scanning-line driving circuit for outputting data to the data line corresponding to the pixel to which data is written. This method includes a first step of outputting data to the data line corresponding to the pixel to which data is written, a second step of storing an electric charge corresponding to the data supplied via the data line in a capacitor owned by the pixel to which data is written, a third step of causing a drive transistor owned by the pixel to which data is written to set a driving current according to the electric charge stored in the capacitor and to supply the set driving current to an electro-optical element for emitting light with a brightness corresponding to the driving current, and a fourth step of repeatedly interrupting the current path for the driving current for a period after the scanning line corresponding to the pixel to which data is written is selected until the next time this scanning line is selected.

In the eighth aspect of the invention, the first step may include a step of outputting data serving as a data current to the data line, and in the second step, the data current supplied to the data line may be converted into a voltage, and the data may be written to the capacitor according to the converted voltage.

In the eighth aspect of the invention, the first step may include a step of outputting data serving as a data voltage to the data line, and in the second step, the data may be written to the capacitor according to the data voltage supplied to the data line.

In the eighth aspect of the invention, in the fourth step, preferably, the current path for the driving current is repeatedly interrupted in synchronization with the scanning signal supplied to the pixel to which data is written.

A ninth aspect of the invention provides an electro-optical device that may have a plurality of scanning lines, a plurality of data lines, a plurality of pixels located at intersections of the scanning lines and the data lines, a scanning-line driving circuit for outputting a scanning signal to the scanning lines so as to select the scanning line corresponding to a pixel to which data is written, and a data-line driving circuit cooperating with the scanning-line driving circuit for outputting data to the data line corresponding to the pixel to which data is written. Each pixel includes an electro-optical element for emitting light with a brightness corresponding to a driving current, a storage device for storing the data supplied via the data line, a drive element for setting the driving current to be supplied to the electro-optical element according to the data stored in the storage device, and a control element for repeatedly interrupting the current path for the driving current for a period after the scanning line corresponding to the pixel to which data is written is selected until the next time this scanning line is selected.

A tenth aspect of the invention provides a method of driving an electro-optical device that may include a plurality of pixels located at intersections of scanning lines and data lines, a scanning-line driving circuit for outputting a scanning signal to the scanning lines so as to select the scanning line corresponding to a pixel to which data is written, and a data-line driving circuit cooperating with the scanning-line driving circuit for outputting data to the data line corresponding to the pixel to which data is written. This method can include a first step of outputting data to the data line corresponding to the pixel to which data is written, a second step of storing the data supplied via the data line in a storage device owned by the pixel to which data is written to write the data, a third step of causing a drive element owned by the pixel to which data is written to set a driving current according to the data stored in the storage device and to supply the set driving current to a current-driven electro-optical element for emitting light with a brightness corresponding to the driving current, and a fourth step of repeatedly interrupting the current path for the driving current for a period after the scanning line corresponding to the pixel to which data is written is selected until the next time this scanning line is selected.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

This embodiment relates to a current-programmed electro-optical device, and particularly to display control of an active-matrix display including pixels each having a current mirror circuit. As used herein, the current-programmed type refers to a type in which data is supplied to data lines based on current.

Figure 1:
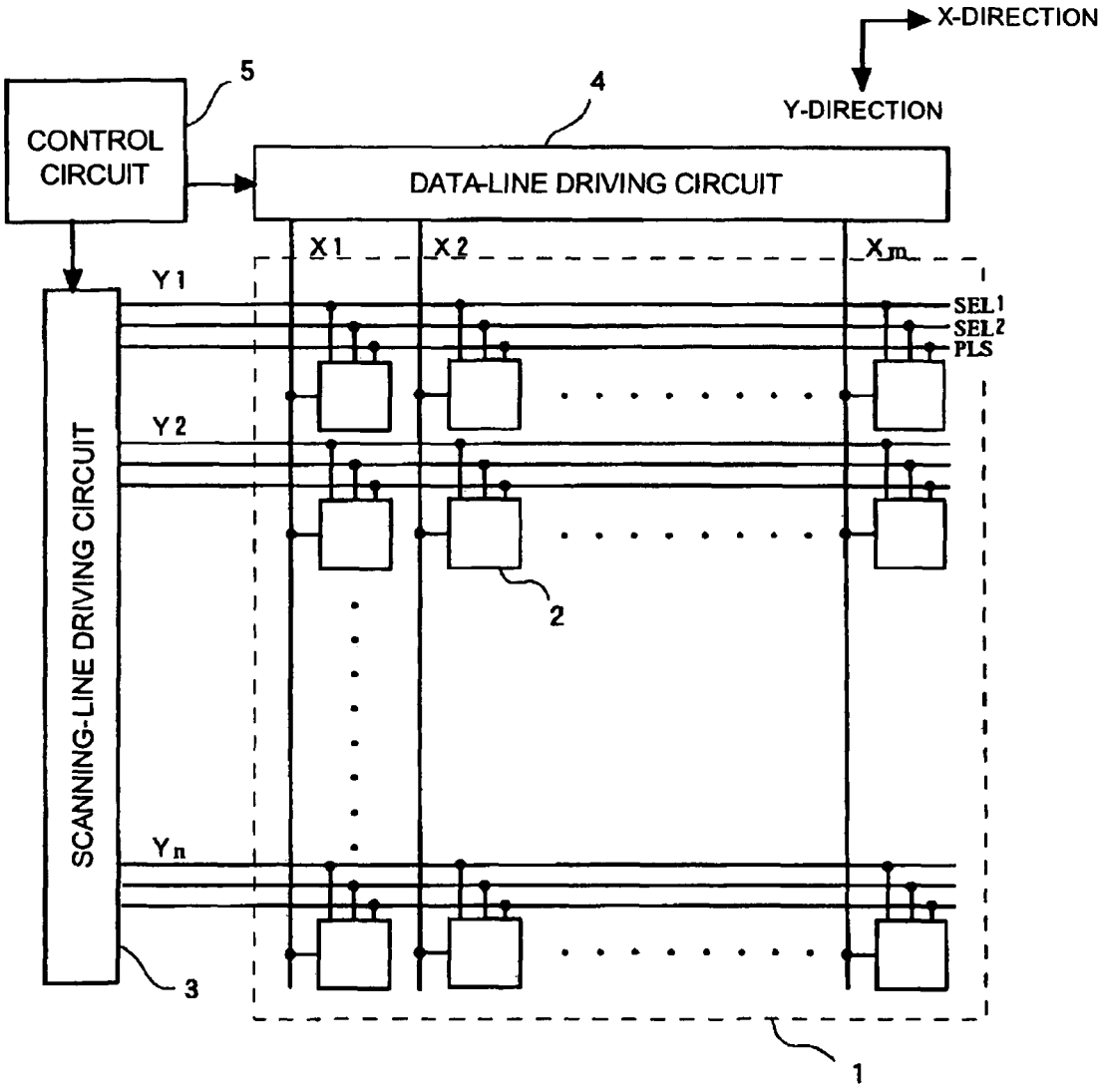
FIG. 1 is a block diagram of an electro-optical device according to a first embodiment.

FIG. 1 is an exemplary block diagram of an electro-optical device. A display unit 1 includes a matrix (two-dimensional array) of pixels 2 of m dots by n lines, horizontal lines Y1 to Yn extending in the horizontal direction, and data lines X1 to Xm extending in the vertical direction. Each horizontal line Y (Y indicates any one of Y1 to Yn) is formed of two scanning lines and a single signal line, to which a first scanning signal SEL1, a second scanning signal SEL2, and a pulse signal PLS are output, respectively. Although the scanning signals SEL1 and SEL2 are basically logically exclusive, one of the signals may be slightly shifted with respect to the other. The pixels 2 are located at intersections of the horizontal lines Y1 to Yn and the data lines X1 to Xm. The pulse signal PLS is a control signal for impulse-driving an electro-optical element forming a given pixel 2 for a period after the given pixel 2 is selected until the next time this pixel 2 is selected (in this embodiment, for one vertical scanning period). In this embodiment, each pixel 2 is used as a minimum unit of image display, but each pixel 2 may be formed of a plurality of sub-pixels. In FIG. 1, power lines, etc., for supplying predetermined fixed potentials Vdd and Vss to the pixels 2 are not shown.

A control circuit 5 synchronously controls a scanning-line driving circuit 3 and a data-line driving circuit 4 based on a vertical synchronizing signal Vs, a horizontal synchronizing signal Hs, a dot clock signal DCLK, gray-scale data D, and so on, which are input from a high-level device (not shown). Under this synchronous control, the scanning-line driving circuit 3 and the data-line driving circuit 4 cooperate with each other to perform display control of the display unit 1.

The scanning-line driving circuit 3 is mainly formed of a shift register, an output circuit, and so on, and outputs the scanning signals SEL1 and SEL2 to the scanning lines to sequentially select the scanning lines. Such sequential line scanning allows pixel rows each corresponding to the pixels of one horizontal line to be sequentially selected for one vertical scanning period in a predetermined scanning direction (typically, from the top to the bottom).

The data-line driving circuit 4 is mainly formed of a shift register, a line latch circuit, an output circuit, and so on. In this embodiment, a current-programmed type is used, and the data-line driving circuit 4 includes a variable current source for converting data (data voltage Vdata) indicating the gray-scale displayed by the pixels 2 into data current Idata. In one horizontal scanning period, the data-line driving circuit 4 outputs the data current Idata at the same time to all pixels of the pixel row to which data is written this time, and also dot-sequentially latches the data for a pixel row to which data is written in the next horizontal scanning period. In a given horizontal scanning period, m pieces of data corresponding to the number of data lines X are sequentially latched. In the next horizontal scanning period, the m latched pieces of data are converted into data current Idata, and are then output at the same time to the data lines X1 to Xm. The present invention is also applicable to a mechanism in which data are line-sequentially input directly from a frame memory or the like (not shown) to the data-line driving circuit 4, in which case the operation of the main portion of the present invention is similar, and a description thereof is thus omitted. In this case, the shift register is not required in the data-line driving circuit 4.

Figure 2:
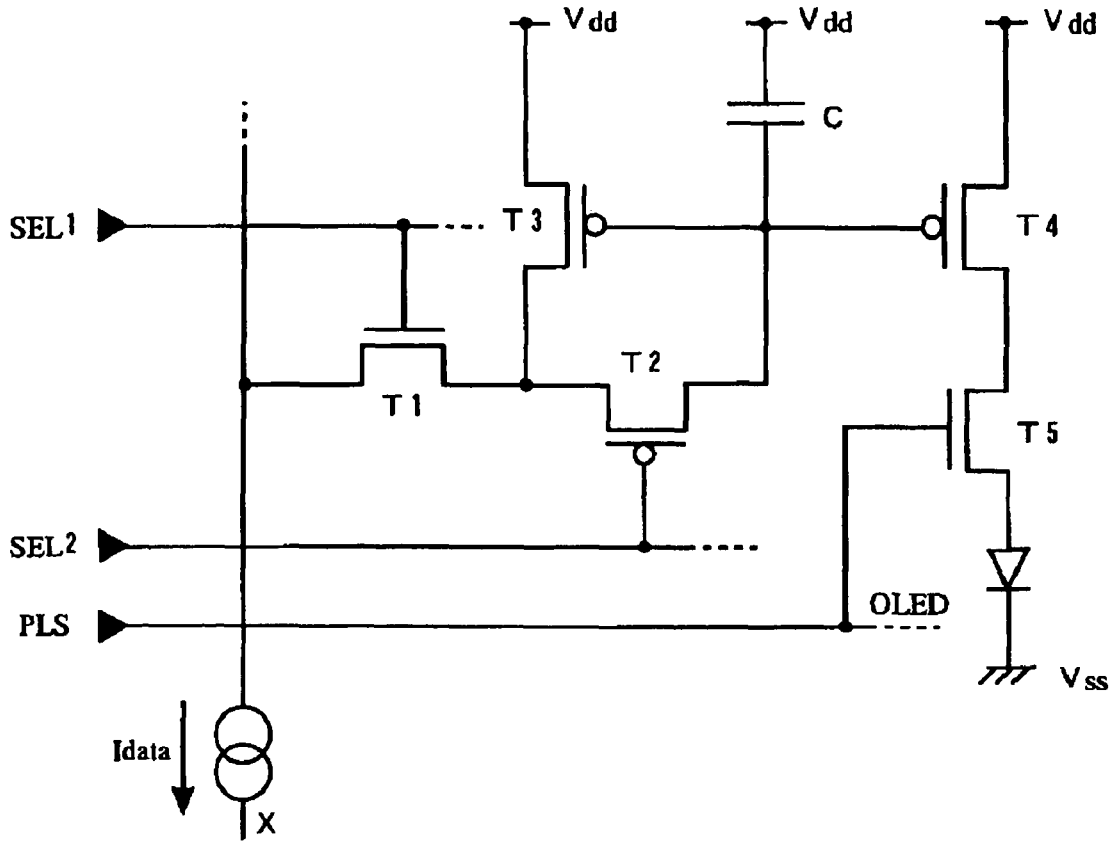
FIG. 2 is a circuit diagram of each pixel according to the first embodiment.

FIG. 2 is an exemplary circuit diagram of each pixel 2 according to this embodiment. Each pixel 2 is formed of an organic EL element OLED, five transistors T1 to T5, which are active elements, and a capacitor C for storing data. The organic EL element OLED, indicated as a diode, is a current-driven element whose brightness is controlled by a driving current Ioled flowing therein. In this pixel circuit, the n-channel transistors T1 and T5 and the p-channel transistors T2 to T4 are used, however, this is merely an example, and it should be understood that the present invention is not limited thereto.

The first switching transistor T1 has a gate connected with a scanning line to which the first scanning signal SEL1 is supplied, and a source connected with a data line X (X indicates any one of X1 to Xm) to which the data current Idata is supplied. A drain of the first switching transistor T1 is commonly connected with a drain of the second switching transistor T2 and a drain of the programming transistor T3. A source of the second switching transistor T2 having a gate to which the second scanning signal SEL2 is supplied is commonly connected with gates of a pair of the transistors T3 and T4, which form a current mirror circuit, and one electrode of the capacitor C. A power potential Vdd is applied to a source of the programming transistor T3, a source of the drive transistor T4, which is one form of drive element, and the other electrode of the capacitor C. The control transistor T5, which is one form of control element, having a gate to which the pulse signal PLS is supplied, is provided in a current path for the driving current Ioled, namely, between a drain of the drive transistor T4 and an anode of the organic EL element OLED. A potential Vss lower than the power potential Vdd is applied to a cathode of the organic EL element OLED. The programming transistor T3 and the drive transistor T4 form a current mirror circuit in which the gates of both transistors are connected with each other. Thus, the current level of the data current Idata flowing in the channel of the programming transistor T3 has a proportional relation to the current level of the driving current Ioled flowing in the channel of the drive transistor T4.

Figure 3:
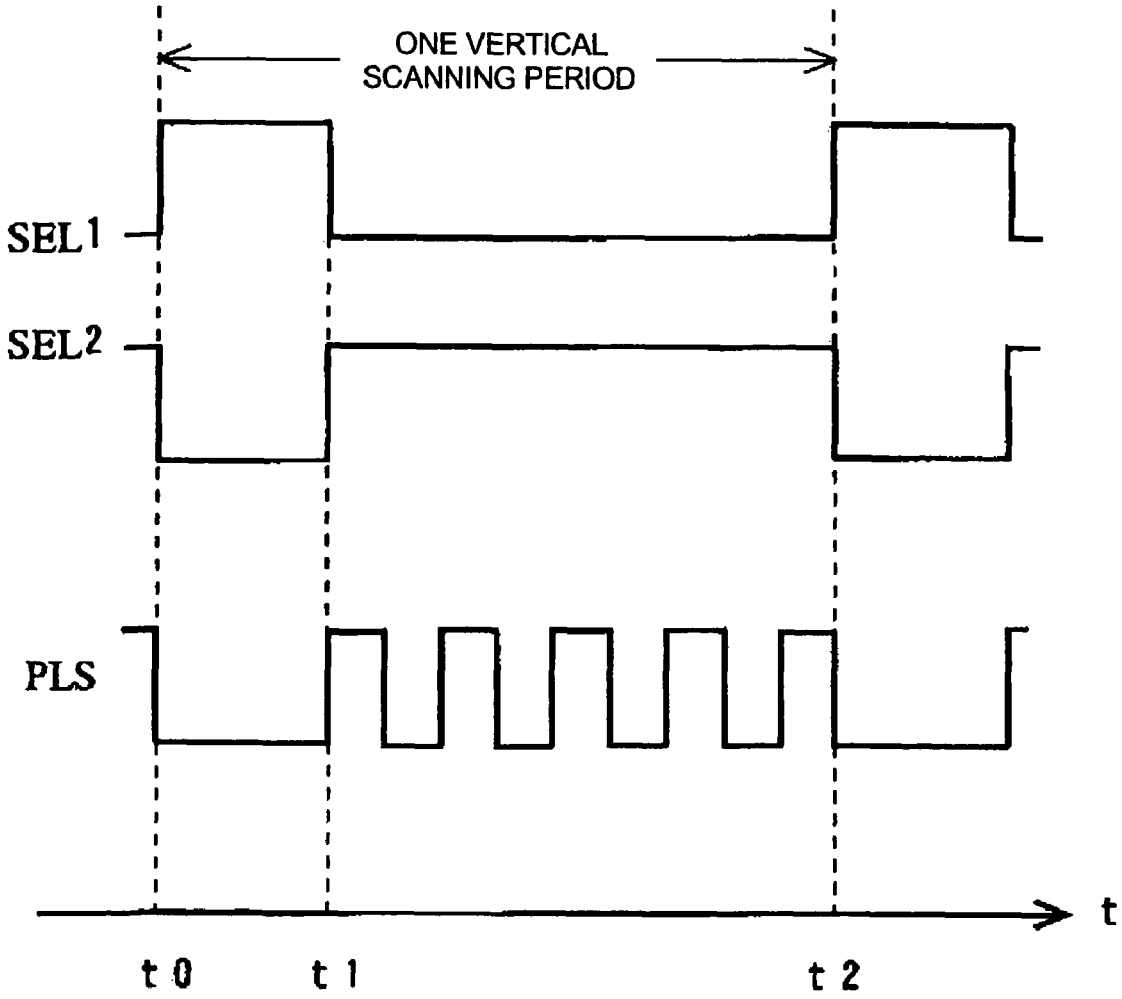
FIG. 3 is a drive timing chart of each pixel according to the first embodiment.

FIG. 3 is an exemplary drive timing chart of each pixel 2 according to this embodiment. It is assumed that the time when selection of a given pixel 2 starts by sequential line scanning of the scanning-line driving circuit 3 is indicated by to and the time when the next time selection of this pixel 2 starts is indicated by t2. One vertical scanning period to t2 can be divided into a first half, or a programming period t0 to t1, and a last half, or a driving period t1 to t2.

In the programming period t0 to t1, upon selection of the pixel 2, data is written in the capacitor C. At the time t0, the first scanning signal SEL1 rises to a high level (hereinafter referred to as an "H level"), and the first switching transistor T1 is turned on. Thus, the data line X is electrically connected to the drain of the programming transistor T3. In synchronization with the rise time of the first scanning signal SEL1, the second scanning signal SEL2 falls to a low level (hereinafter referred to as an L level), and the second switching transistor T2 is also turned on. Thus, the programming transistor T3 is brought into diode connection, that is, its gate is connected with its drain, and functions as a non-linear resistor. Therefore, the programming transistor T3 causes the data current Idata supplied from the data line X to flow in the channel thereof, and generates a gate voltage Vg corresponding to the data current Idata at the gate thereof. An electric charge corresponding to the generated gate voltage Vg is stored in the capacitor C connected with the gate of the programming transistor T3 to write the data.

In the programming period t0 to t1, the pulse signal PLS is maintained at the L level, and the control transistor T5 is off. Thus, the current path to the organic EL element OLED is continuously interrupted irrespective of the relationship between the thresholds of the pair of transistors T3 and T4 forming the current mirror circuit. Therefore, the organic EL element OLED does not emit light for the period t0 to t1.

Then in the driving period t1 to t2, the driving current Ioled corresponding to the electric charge stored in the capacitor C flows in the organic EL element OLED, and the organic EL element OLED emits light. At the time t1, the first scanning signal SEL1 falls to the L level, and the first switching transistor T1 is turned off. Thus, the data line X and the drain of the programming transistor T3 are electrically separated from each other so as to stop supplying the data current Idata to the programming transistor T3. In synchronization with the fall time of the first scanning signal SEL1, the second scanning signal SEL2 rises to the H level, and the second switching transistor T2 is also turned off. Thus, the gate and drain of the programming transistor T3 are electrically separated from each other. Due to the electric charge stored in the capacitor C, a voltage equivalent to the gate voltage Vg is applied to the gate of the drive transistor T4.

In synchronization with the fall time of the first scanning signal SEL1 at the time t1, the pulse signal PLS, which has been kept at the L level, changes to a signal with pulse waveform which alternates between the H level and the L level. This pulse waveform continues until the time t2 at which next selection of the pixel 2 starts. Thus, the control transistor T5 whose conduction is controlled by the pulse signal PLS alternates between the on state and the off state. When the control transistor T5 is in the on state, a current path passing through the drive transistor T4, the control transistor T5, and the organic EL element OLED is formed from the power potential Vdd to the potential Vss. The driving current Ioled flowing in the organic EL element OLED corresponds to a channel current of the drive transistor T4 which sets the current value of the driving current Ioled, and is controlled by the gate voltage Vg related to the electric charge stored in the capacitor C. The organic EL element OLED emits light with a brightness corresponding to the driving current Ioled. The above-described current mirror structure allows the driving current Ioled (the channel current of the drive transistor T4), which defines the brightness of the organic EL element OLED, to be proportional to the data current Idata (the channel current of the programming transistor T3) supplied from the data line X. On the other hand, when the control transistor T5 is in the off state, the current path for the driving current Ioled is forcibly interrupted by the control transistor T5. Therefore, light emission of the organic EL element OLED stops temporarily, resulting in a black display, for the off-period of the control transistor T5. Accordingly, the control transistor T5 provided in the current path for the driving current Ioled is turned on and off a plurality of times for the driving period t1 to t2, and therefore light emission and non-light-emission of the organic EL element OLED are repeated a plurality of times.

As described above, in this embodiment, the conduction of the control transistor T5 is controlled to thereby repeat interruption of the current path for the driving current Ioled for the period t0 to t2 after the pixel 2 is selected until the next time it is selected. Thus, light emission and non-light-emission of the organic EL element OLED are carried out a plurality of times for the driving period t1 to t2. As a result, the optical response of the pixel 2 can be approximately an impulse response. Moreover, the non-light-emission time of the organic EL element OLED (the time of black display) can be dispersed in the period t1 to t2, thus reducing flickering of the displayed image. Therefore, the display quality can be improved. The optical response of the pixel 2 can also be improved, and a false contour in moving pictures or the like can effectively be suppressed.

The average brightness of light emission and non-light-emission by the organic EL element OLED is lower than that of continuous light emission. The balance between the light-emission time and the non-light-emission time can be controlled to thereby perform brightness control with ease.

According to this embodiment, since the control transistor T5 is provided in a current path for the driving current Ioled, there is no limitation on the thresholds of the pair of transistors T3 and T4 forming the current mirror circuit. The above-described pixel circuit using a current mirror circuit, disclosed in Japanese Unexamined Patent Application Publication No. 2001-60076, does not include the control transistor T5 in a current path for the driving current Ioled. Therefore, the threshold of the drive transistor T4 must be set not lower than the threshold of the programming transistor T3. This is because, otherwise, the drive transistor T4 is turned on before the data writing to the capacitor C is completed, thus generating leakage current, which causes light emission of the organic EL element OLED.

Another possible problem is that the drive transistor T4 cannot be completely turned off and the organic EL element OLED cannot be completely extinguished or cannot be displayed as black. According to this embodiment, in contrast, the control transistor T5 is added in a current path for the driving current Ioled, and is turned off for the programming period t0 to t1, thus allowing the current path for the driving current Ioled to be forcibly cut off irrespective of the relationship between the thresholds of the transistors T3 and T4. This ensures that light emission of the organic EL element OLED caused by the leakage current of the drive transistor T4 is prevented for the programming period t0 to t1, thus improving the display quality.

Figure 4:
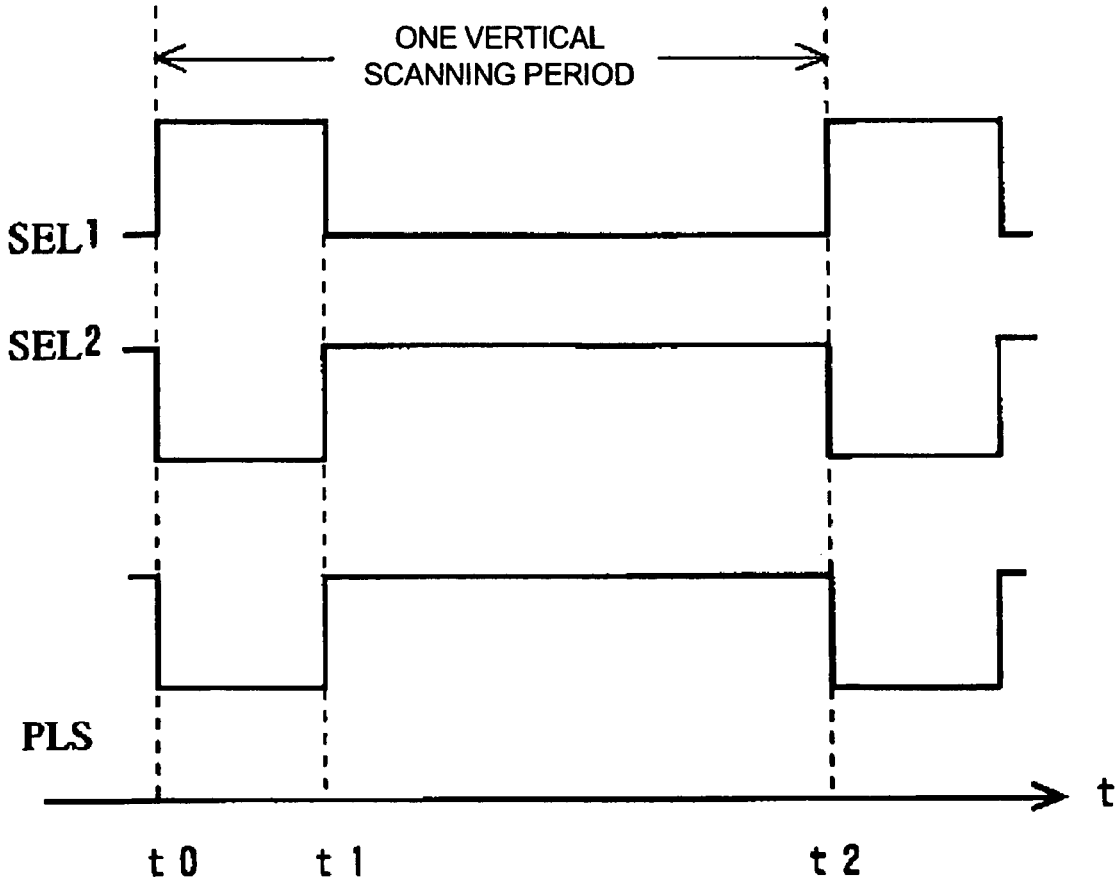
FIG. 4 is another drive timing chart of each pixel according to the first embodiment.

The foregoing embodiment has been described in the context of conversion of the waveform of the pulse signal PLS to pulse form for the driving period t1 to t2. However, in view of only prevention of light emission by the organic EL element OLED caused by the leakage current, it is sufficient that the control transistor T5 be turned off at least for the programming period t0 to t1. Therefore, as shown in, for example, FIG. 4, the pulse signal PLS may be maintained at the L level for the programming period t0 to t1, and the pulse signal PLS may be maintained at the H level for the subsequent driving period t1 to t2. Even if the second switching transistor T2 is replaced with an n-channel transistor in which the scanning signal SELL is connected to the gate of the transistor T2, a similar advantage can be achieved. In this case, the scanning line SEL1 is no longer necessary, thus reducing the pixel circuit size, which contributes to high yield or high aperture ratio.

This embodiment relates to a current-programmed pixel circuit structure in which a drive transistor also functions as a programming transistor. The overall structure of the electro-optical device of this embodiment and the following embodiments is basically similar to that shown in FIG. 1 except for the structure of each horizontal line Y. In this embodiment, each horizontal line Y is formed of a single scanning line to which a scanning signal SEL is supplied and a single signal line to which a pulse signal PLS is supplied.

Figure 5:
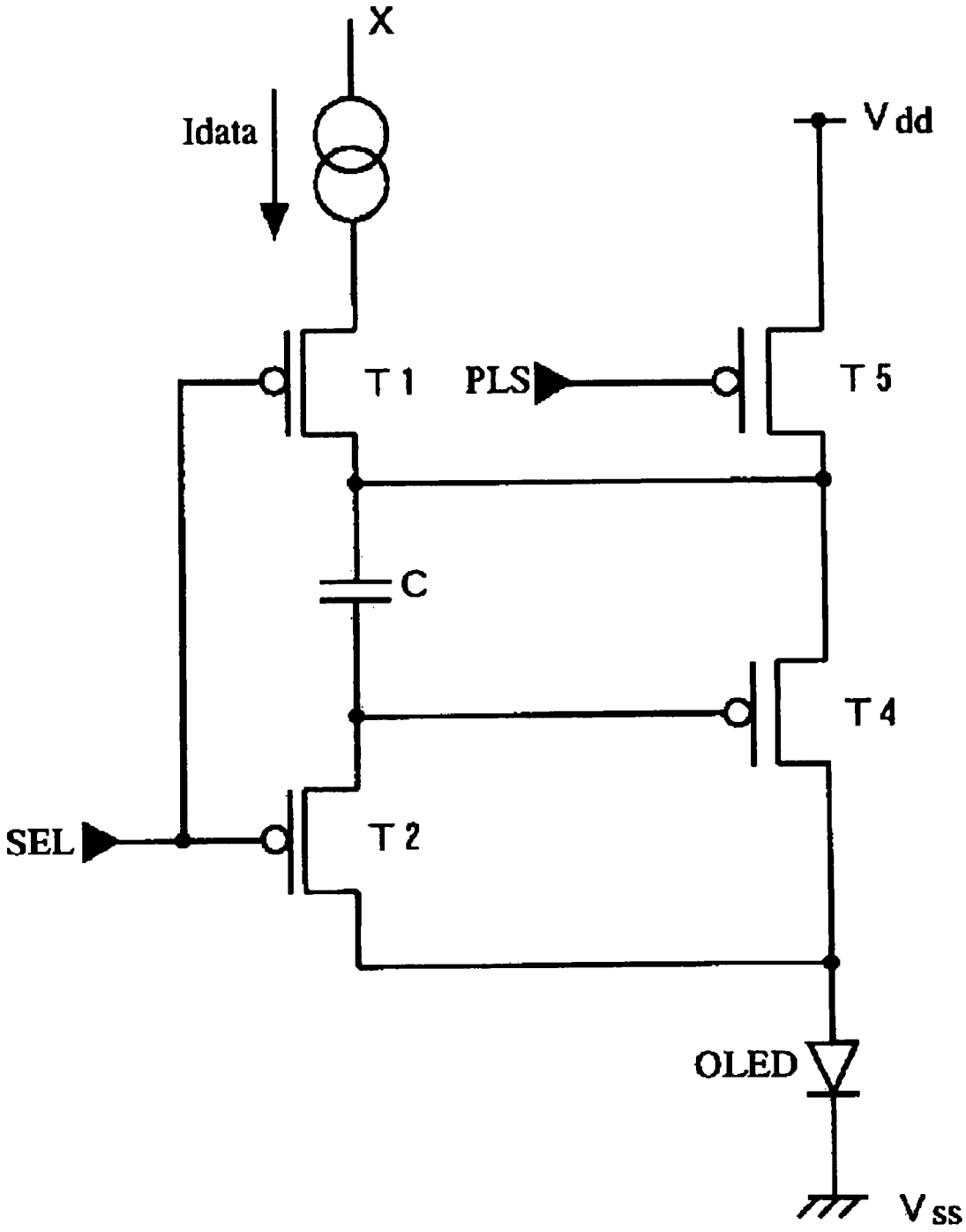
FIG. 5 is a circuit diagram of each pixel according to a second embodiment.

FIG. 5 is an exemplary circuit diagram of each pixel 2 according to this embodiment. Each pixel 2 is formed of an organic EL element OLED, four transistors T1, T2, T4, and T5, and a capacitor C. In the pixel circuit according to this embodiment, the transistors T1, T2, T4, and T5 are p-channel transistor, however, this is merely an example, and it should be understood that the present invention is not limited thereto.

The first switching transistor T1 has a gate connected with a scanning line to which a scanning signal SEL is supplied, and a source connected with a data line X to which data current Idata is supplied. A drain of the first switching transistor T1 is commonly connected with a drain of the control transistor T5, a source of the drive transistor T4, and one electrode of the capacitor C. The other electrode of the capacitor C is commonly connected with a gate of the drive transistor T4 and a source of the second switching transistor T2. Like the first switching transistor T1, a gate of the second switching transistor T2 is connected with the scanning line to which the scanning signal SEL is supplied. A drain of the second switching transistor T2 is commonly connected with a drain of the drive transistor T4 and an anode of the organic EL element OLED. A potential Vss is applied to a cathode of the organic EL element OLED. A gate of the control transistor T5 is connected with a signal line to which a pulse signal PLS is supplied, and a power potential Vdd is applied to a source of the control transistor T5.

Figure 6:
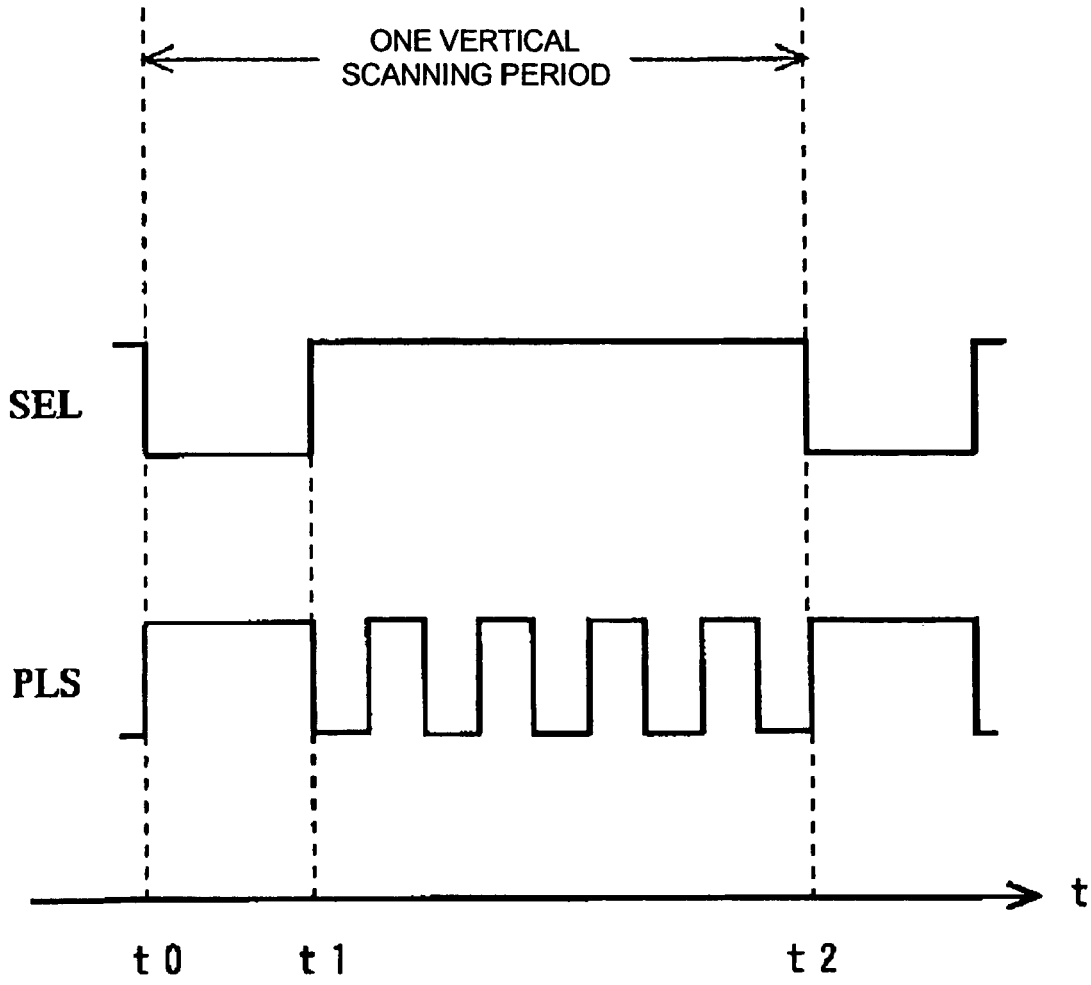
FIG. 6 is a drive timing chart of each pixel according to the second embodiment.

FIG. 6 is an exemplary drive timing chart of each pixel 2 according to this embodiment. In the pixel circuit shown in FIG. 5, substantially entirely for one vertical scanning period t0 to t2, a current flows in the organic EL element OLED, and the organic EL element OLED emits light. Like the foregoing embodiment, one vertical scanning period t0 to t2 can be divided into a programming period t0 to t1 and a driving period t1 to t2.

First, in the programming period t0 to t1, upon selection of the pixel 2, data is written in the capacitor C. At the time t0, the scanning signal SEL falls to the L level, and the switching transistors T1 and T2 are turned on. Thus, the data line X is electrically connected to the source of the drive transistor T4, and the drive transistor T4 is brought into diode connection, that is, its gate and drain are electrically connected with each other. Therefore, the drive transistor T4 causes the data current Idata supplied from the data line X to flow in the channel thereof, and generates a gate voltage Vg corresponding to the data current Idata at the gate thereof. An electric charge corresponding to the generated gate voltage Vg is stored in the capacitor C connected between the gate and source of the drive transistor T4 to write the data. Accordingly, the drive transistor T4 functions as a programming transistor for writing data in the capacitor C for the programming period to t1.

In the programming period t0 to t1, the pulse signal PLS is maintained at the H level, and the control transistor T5 is off. Thus, a current path for the driving current Ioled which is formed from the power potential Vdd to the potential Vss is continuously interrupted. However, a current path for the data current Idata is formed between the data line X and the potential Vss via the first switching transistor T1, the drive transistor T4, and the organic EL element OLED. Therefore, the organic EL element OLED still emits light with a brightness corresponding to the data current Idata for the programming period t0 to t1.

Then in the driving period t1 to t2, the driving current Ioled corresponding to the electric charge stored in the capacitor C flows in the organic EL element OLED, and the organic EL element OLED emits light. At the driving start time t1, the scanning signal SEL rises to the H level, and the switching transistors T1 and T2 are turned off. Thus, the data line X to which the data current Idata is supplied and the source of the drive transistor T4 are electrically separated from each other, and the gate and drain of the drive transistor T4 are also electrically separated from each other. Due to the electric charge stored in the capacitor C, a voltage equivalent to the gate voltage Vg is applied to the gate of the drive transistor T4.

In synchronization with the rise time of the scanning signal SEL at the time t1, the pulse signal PLS, which has been kept at the H level, changes to a signal with pulse waveform. Thus, the control transistor T5 whose conduction is controlled by the pulse signal PLS alternates between the on state and the off state. When the control transistor T5 is in the on state, a current path for the driving current Ioled is formed. The driving current Ioled flowing in the organic EL element OLED is controlled by the gate voltage Vg related to the electric charge stored in the capacitor C, and the organic EL element OLED emits light with a brightness corresponding to this current level. On the other hand, when the control transistor T5 is in the off state, the current path for the driving current Ioled is forcibly interrupted by the control transistor T5. The conduction of the control transistor T5 is controlled to thereby cause intermittent light emission of the organic EL element OLED for the driving period t1 to t2.

As described above, in this embodiment, the conduction of the control transistor T5 is controlled to thereby repeat interruption of the current path for the driving current Ioled for the period t0 to t2 after the pixel 2 is selected until the next time it is selected. Thus, light emission and non-light-emission of the organic EL element OLED are carried out a plurality of times for the driving period t1 to t2. As a result, like the first embodiment, the optical response of the pixel 2 can be approximately an impulse response. Moreover, the non-light-emission time of the organic EL element OLED (the time of black display) can be dispersed in the period t1 to t2, thus reducing flickering of the displayed image. Therefore, the display quality can be improved. The optical response of the pixel 2 can also be further improved, and a false contour in moving pictures can effectively be suppressed.

The average brightness of light emission and non-light-emission by the organic EL element OLED is lower than that of continuous light emission. The balance between the light-emission time and the non-light-emission time can be controlled to thereby perform brightness control with ease.

In this embodiment, intermittent light emission of the organic EL element OLED is carried out by controlling the conduction of the control transistor T5 provided in the current path for the driving current Ioled. However, as shown in, for example, FIG. 7 or 8, a second control transistor T6, which is different from the control transistor T5, may be additionally provided in the current path for the driving current Ioled, thus achieving a similar advantage. In the pixel circuit shown in FIG. 7, the second control transistor T6 is connected between the drain of the first control transistor T5 and the source of the drive transistor T4. In the pixel circuit shown in FIG. 8, the second control transistor T6 is connected between the drain of the drive transistor T4 and the anode of the organic EL element OLED. The second control transistor T6 may be, for example, an n-channel transistor having a gate to which the pulse signal PLS is supplied. A control signal GP is supplied to the gate of the first control transistor T5.

Figure 7:
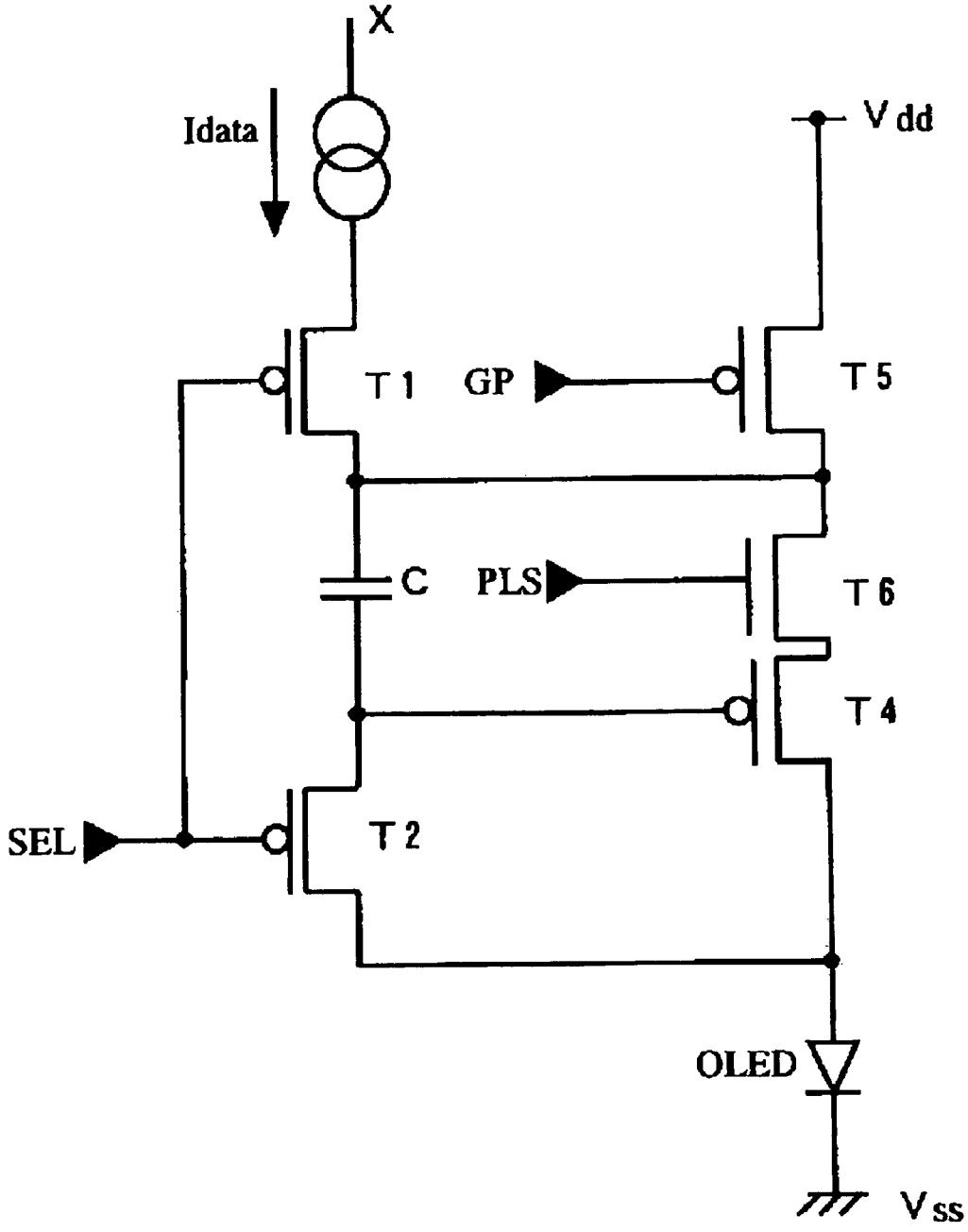
FIG. 7 is a circuit diagram of a modification of each pixel according to the second embodiment.
Figure 8:
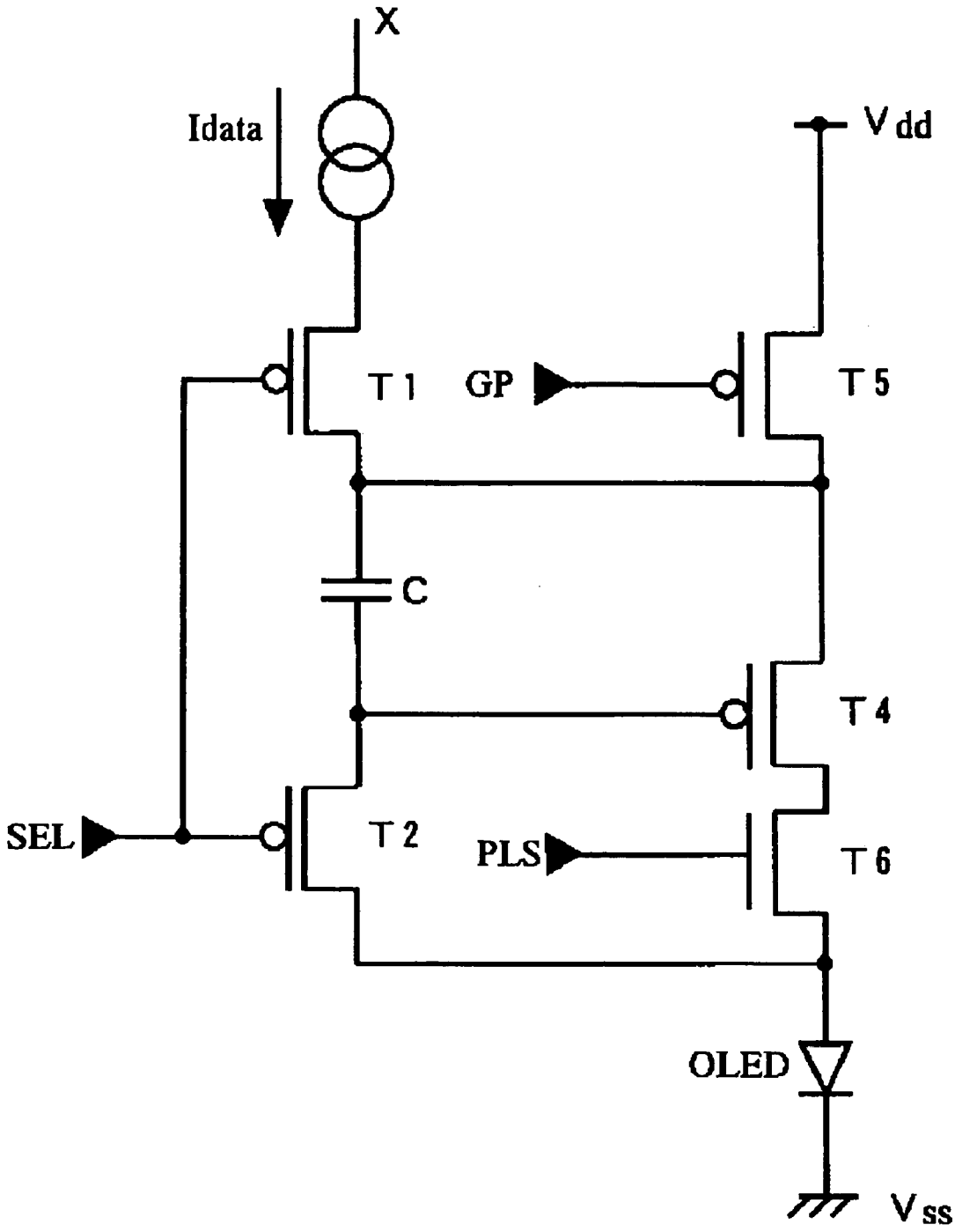
FIG. 8 is a circuit diagram of another modification of each pixel according to the second embodiment.
Figure 9:
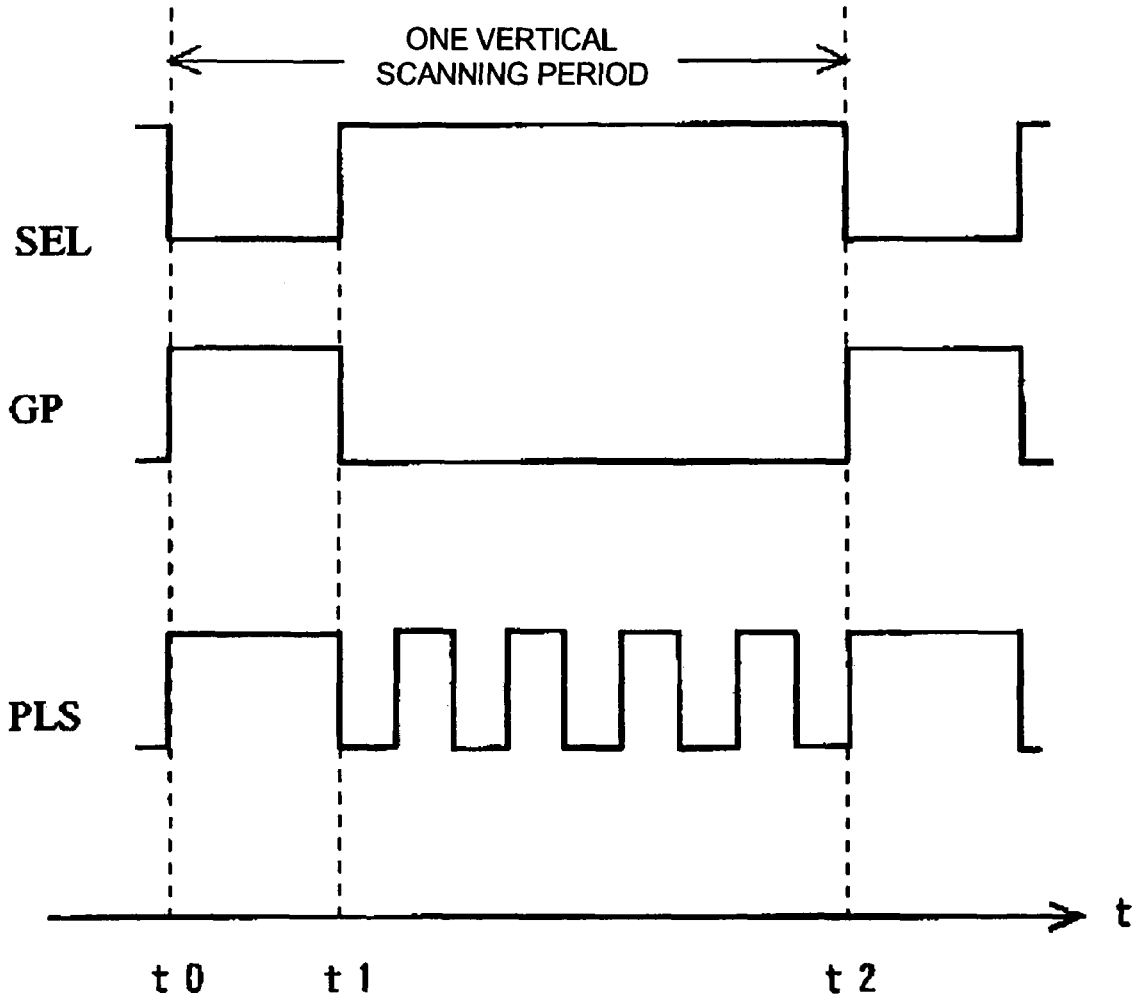
FIG. 9 is a drive timing chart of each pixel according to the second embodiment.

FIG. 9 is an exemplary drive timing chart of the pixel 2 shown in FIG. 7 or 8. The control signal GP is maintained at the H level for the programming period t0 to t1. Thus, the current path for the driving current Ioled is interrupted a plurality of times by the control transistor T5 whose conduction is controlled by the control signal GP. In the programming period t0 to t1, the pulse signal PLS is at the H level, and therefore the second control transistor T6 is turned on. Thus, like the pixel circuit shown in FIG. 5, a current path for the data current Idata is formed so as to write the data in the capacitor C, and the organic EL element OLED emits light. In the subsequent driving period t1 to t2, the control signal GP is at the H level, and the pulse signal PLS changes to a signal with pulse waveform. Thus, the conduction of the second control transistor T6 is controlled by the pulse signal PLS to thereby cause light emission of the organic EL element OLED to be intermittently repeated.

This embodiment relates to a current-programmed pixel circuit structure in which a drive transistor also functions as a programming transistor. In this embodiment, each horizontal line Y is formed of a single scanning line to which a scanning signal SEL is supplied and a single signal line to which a pulse signal PLS is supplied.

Figure 10:
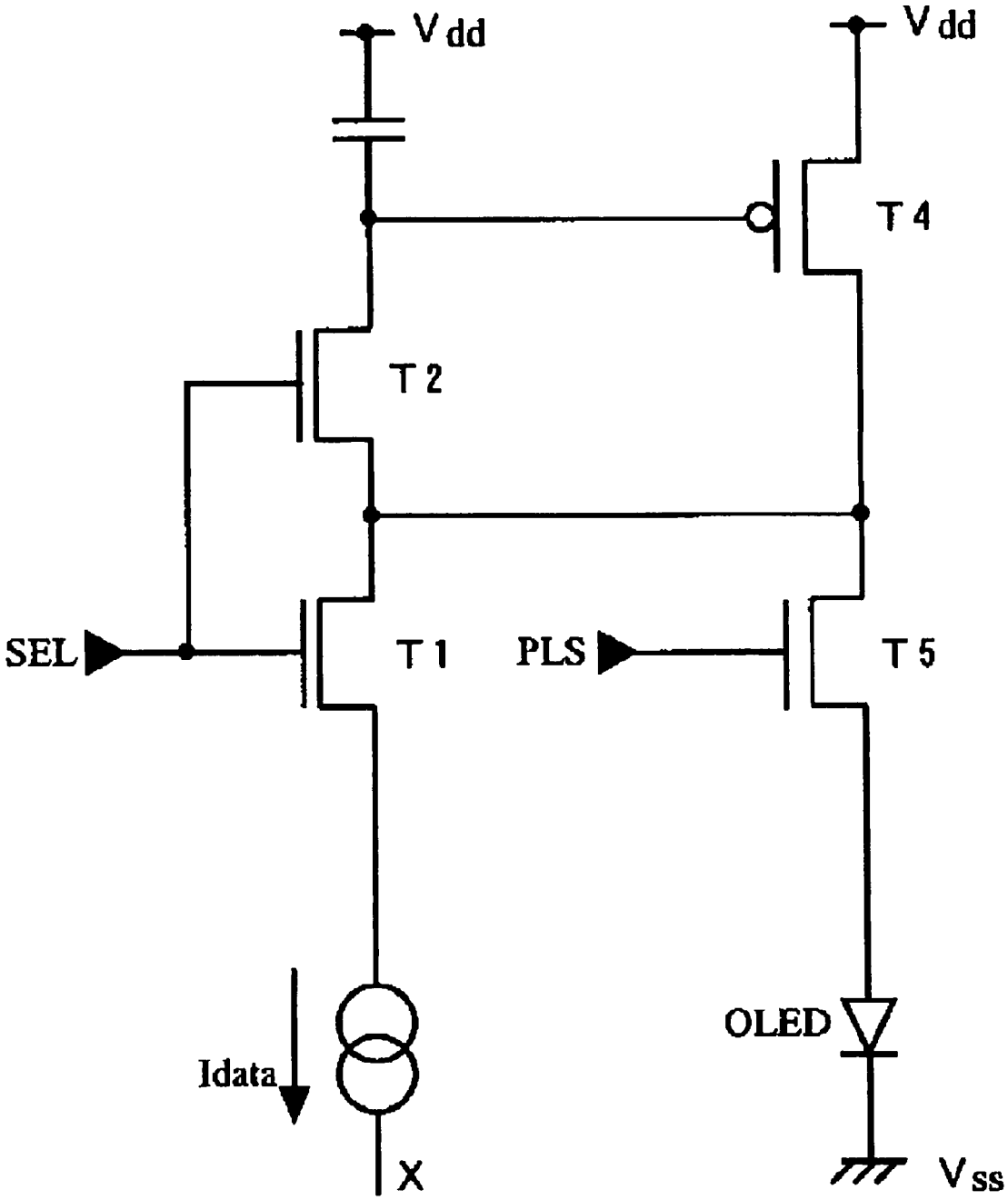
FIG. 10 is a circuit diagram of each pixel according to a third embodiment.

FIG. 10 is an exemplary circuit diagram of each pixel 2 according to this embodiment. Each pixel 2 is formed of an organic EL element OLED, four transistors T1, T2, T4, and T5, and a capacitor C. In the pixel circuit according to this embodiment, the n-channel transistors T1, T2, and T5 and the p-channel transistor T4 are used, however, this is merely an example, and it should be understood that the present invention is not limited thereto.

The first switching transistor T1 has a gate connected with a scanning line to which a scanning signal SEL is supplied, and a source connected with a data line X to which data current Idata is supplied. A drain of the first switching transistor T1 is commonly connected with a source of the second switching transistor T2, a drain of the drive transistor T4, and a drain of the control transistor T5. Like the first switching transistor T1, a gate of the second switching transistor T2 is connected with the scanning line to which the scanning signal SEL is supplied. A drain of the second switching transistor T2 is commonly connected with one electrode of the capacitor C and a gate of the drive transistor T4. A power potential Vdd is applied to the other electrode of the capacitor C and a source of the drive transistor T4. The control transistor T5 having a gate to which the pulse signal PLS is supplied is provided between the drain of the drive transistor T4 and an anode of the organic EL element OLED. A potential Vss is applied to a cathode of the organic EL element OLED.

Figure 11:
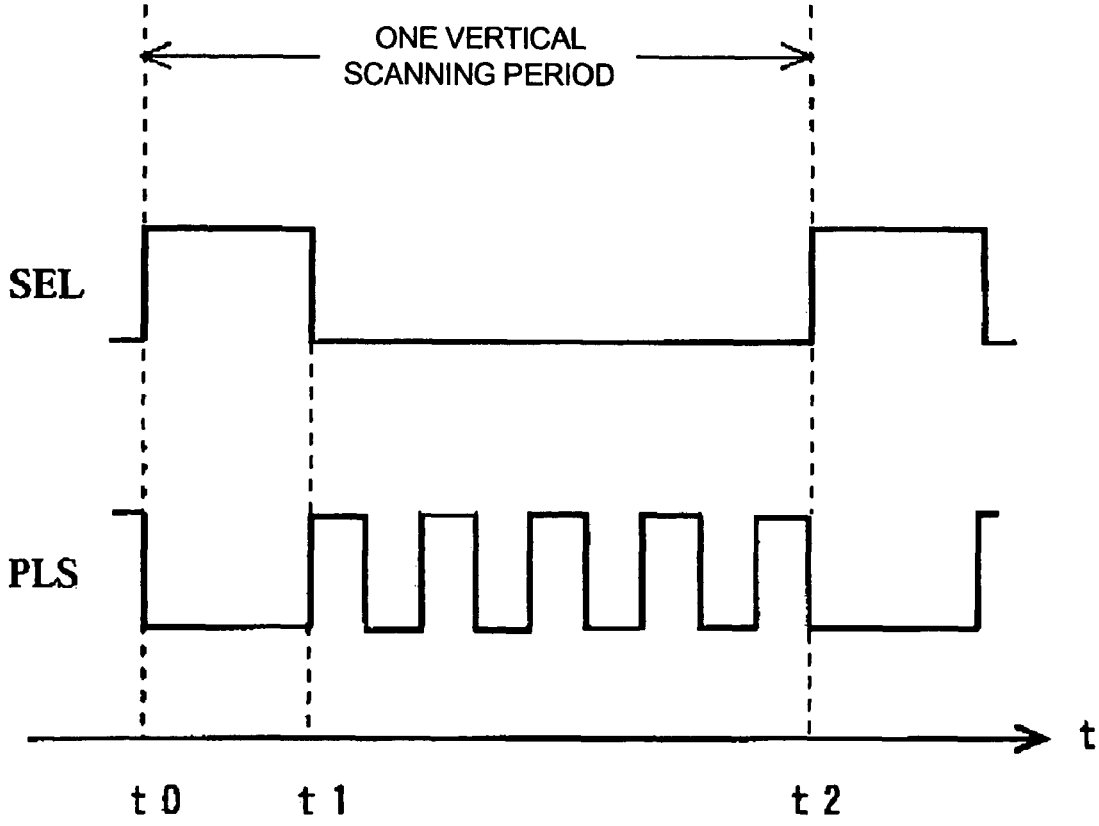
FIG. 11 is a drive timing chart of each pixel according to the third embodiment.

FIG. 11 is an exemplary drive timing chart of each pixel 2 according to this embodiment. Like the foregoing embodiments, one vertical scanning period t0 to t2 can be divided into a programming period t0 to t1 and a driving period t1 to t2.

First, in the programming period t0 to t1, upon selection of the pixel 2, data is written in the capacitor C. At the time t0, the scanning signal SEL rises to the H level, and the switching transistors T1 and T2 are turned on. Thus, the data line X and the drain of the drive transistor T4 are electrically connected with each other, and the drive transistor T4 is brought into diode connection, that is, its gate and drain are electrically connected with each other. Therefore, the drive transistor T4 causes the data current Idata supplied from the data line X to flow in the channel thereof, and generates a gate voltage Vg corresponding to the data current Idata at the gate thereof. An electric charge corresponding to the generated gate voltage Vg is stored in the capacitor C connected with the gate of the drive transistor T4 to write the data. Accordingly, the drive transistor T4 functions as a programming transistor for writing data in the capacitor C for the programming period t0 to t1.

In the programming period t0 to t1, the pulse signal PLS is maintained at the L level, and the control transistor T5 is off. Thus, a current path for the driving current Ioled to the organic EL element OLED is continuously interrupted, and the organic EL element OLED does not emit light for the period t0 to t1.

Then in the driving period t1 to t2, the driving current Ioled corresponding to the electric charge stored in the capacitor C flows in the organic EL element OLED, and the organic EL element OLED emits light. At the driving start time t1, the scanning signal SEL falls to the L level, and the switching transistors T1 and T2 are turned off. Thus, the data line X to which the data current Idata is supplied and the drain of the drive transistor T4 are electrically separated from each other, and the gate and drain of the drive transistor T4 are also electrically separated from each other. According to the electric charge stored in the capacitor C, a voltage equivalent to the gate voltage Vg is applied to the gate of the drive transistor T4.

In synchronization with the fall time of the scanning signal SEL at the time t1, the pulse signal PLS, which has been kept at the L level, changes to a signal with pulse waveform. This pulse waveform continues until the time t2 at which next selection of the pixel 2 starts. Thus, the control transistor T5 whose conduction is controlled by the pulse signal PLS alternates between the on state and the off state. When the control transistor T5 is in the on state, a current path for the driving current Ioled is formed, and the organic EL element OLED emits light with a brightness corresponding to the driving current Ioled. On the other hand, when the control transistor T5 is in the off state, the current path for the driving current Ioled is forcibly interrupted by the control transistor T5. The conduction of the control transistor T5 is controlled in this way to thereby cause the current path for the driving current Ioled to be repeatedly interrupted, and light emission and non-light-emission of the organic EL element OLED are therefore carried out a plurality of times.

As described above, in this embodiment, the conduction of the control transistor T5 is controlled to thereby repeat interruption of the current path for the driving current Ioled for the period t0 to t2 after the pixel 2 is selected until the next time it is selected. Thus, light emission and non-light-emission of the organic EL element OLED are carried out a plurality of times for the driving period t1 to t2. As a result, like the first embodiment, the optical response of the pixel 2 can be approximately an impulse response. Moreover, the non-light-emission time of the organic EL element OLED (the time of black display) can be dispersed in the period t1 to t2, thus reducing flickering of the displayed image. Therefore, the display quality can be improved. The optical response of the pixel 2 can also be improved, and a false contour in moving pictures can effectively be suppressed.

The average brightness of light emission and non-light-emission by the organic EL element OLED is lower than that of continuous light emission. The balance between the light-emission time and the non-light-emission time can be controlled to thereby perform brightness control with ease.

This embodiment relates to a voltage-programmed pixel circuit structure, and particularly to a so-called CC (Conductance Control) method. As used herein, the "voltage-programmed" method refers to a method in which data is supplied to a data line X based on voltage. In this embodiment, each horizontal line Y is formed of a single scanning line to which a scanning signal SEL is supplied and a single signal line to which a pulse signal PLS is supplied. In a voltage-programming method, a data voltage Vdata is output directly to the data line X, and therefore the data-line driving circuit 4 does not require a variable current source.

Figure 12:
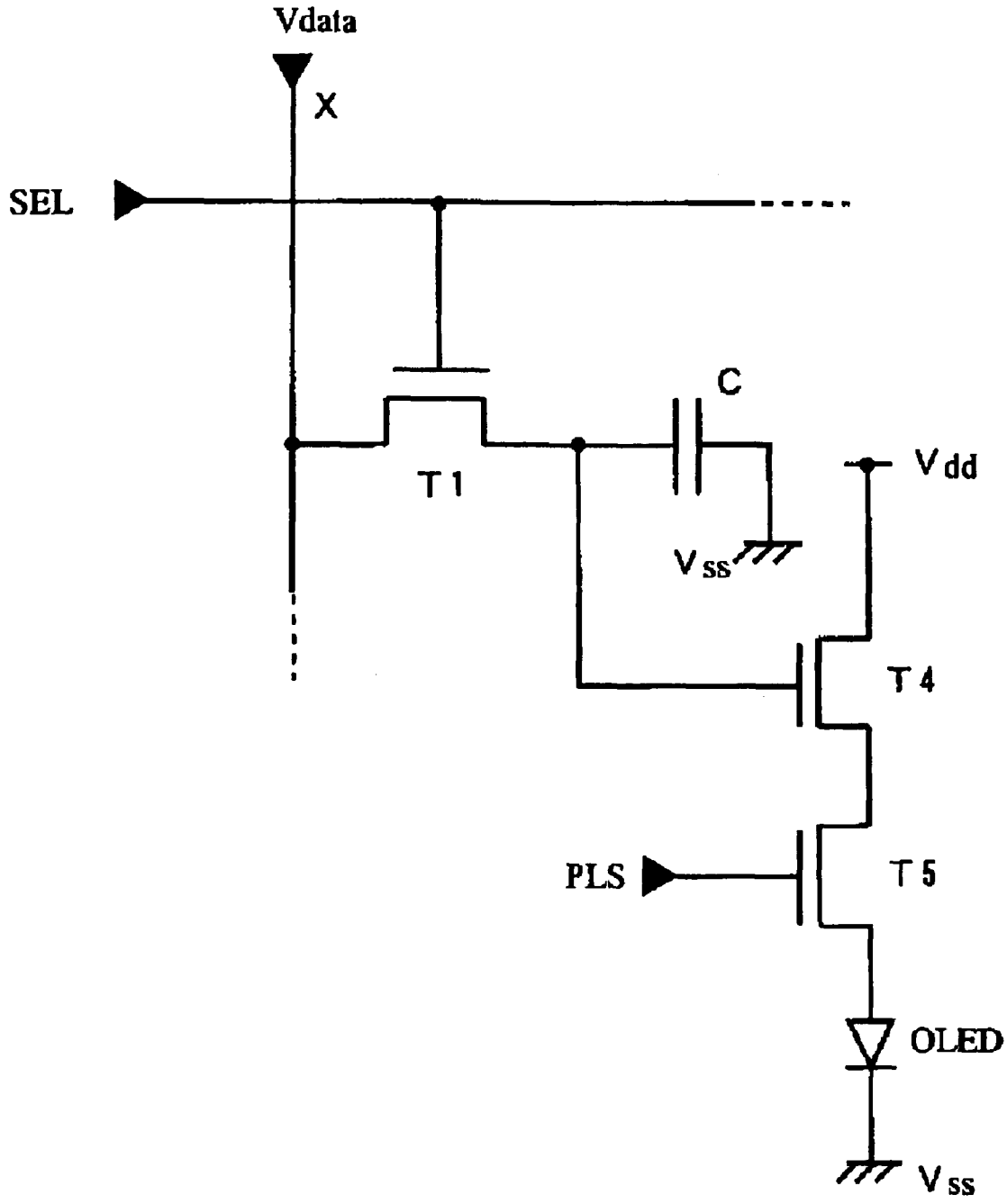
FIG. 12 is a circuit diagram of each pixel according to a fourth embodiment.

FIG. 12 is an exemplary circuit diagram of each pixel 2 according to this embodiment. Each pixel 2 is formed of an organic EL element OLED, three transistors T1, T4, and T5, and a capacitor C. In the pixel circuit according to this embodiment, the transistors T1, T4, and T5 are n-channel transistors, however, this is merely an example, and it should be understood that the present invention is not limited thereto.

The switching transistor T1 has a gate connected with a scanning line to which a scanning signal SEL is supplied, and a drain connected with a data line X to which a data voltage Vdata is supplied. A source of the switching transistor T1 is commonly connected with one electrode of the capacitor C and a gate of the drive transistor T4. A potential Vss is applied to the other electrode of the capacitor C, and a power potential Vdd is applied to a drain of the drive transistor T4. The control transistor T5 whose conduction is controlled by the pulse signal PLS has a source connected with an anode of the organic EL element OLED. A potential Vss is applied to a cathode of the organic EL element OLED.

Figure 13:
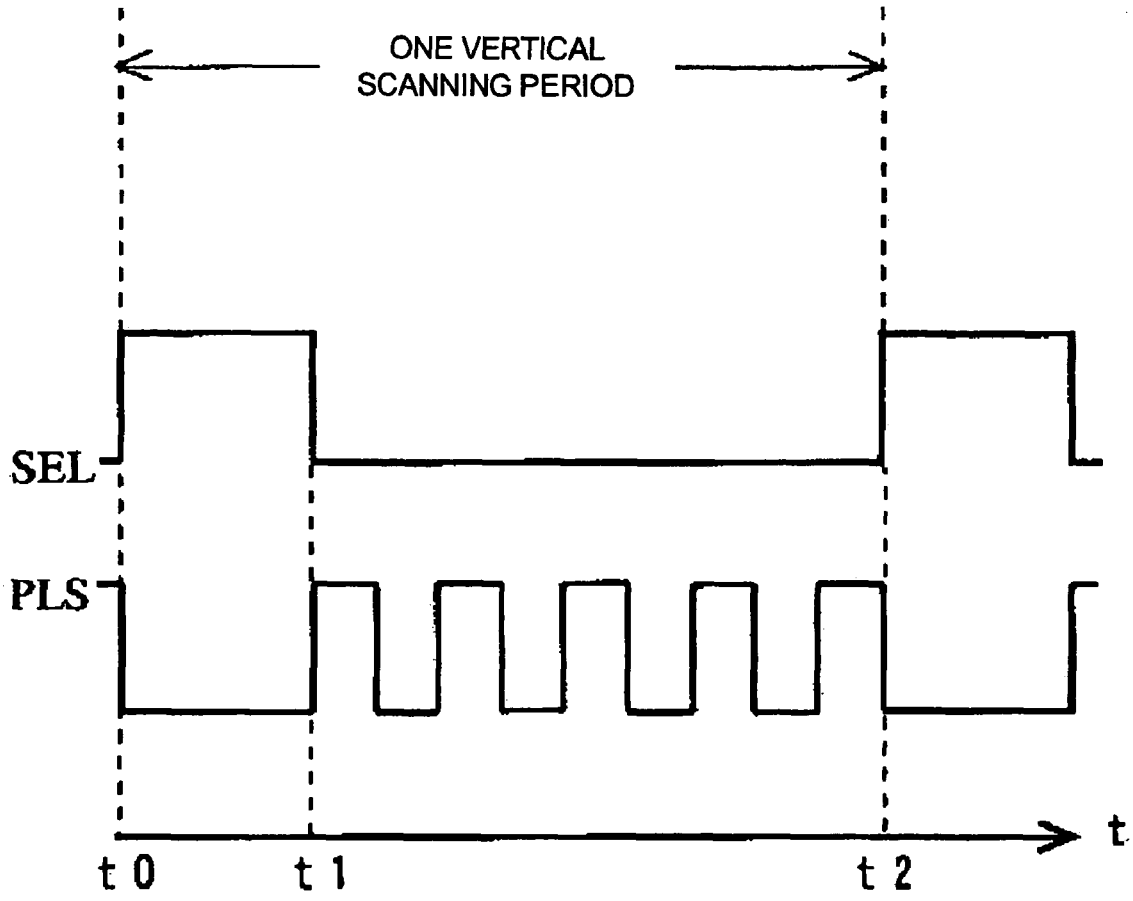
FIG. 13 is a drive timing chart of each pixel according to the fourth embodiment.

FIG. 13 is an exemplary drive timing chart of each pixel 2 according to this embodiment. At a time t0, the scanning line SEL rises to the H level, and the switching transistor T1 is turned on. Thus, the data voltage Vdata supplied to the data line X is applied to one of the electrodes of the capacitor C via the switching transistor T1, and an electric charge corresponding to the data voltage Vdata is stored in the capacitor C (to write data). In the period from the time t0 to a time t1, the pulse signal PLS is maintained at the L level, and the control transistor T5 is off. Therefore, the current path for the driving current Ioled to the organic EL element OLED is interrupted, and the organic EL element OLED does not emit light for the first half period to t1.

In the last half period t1 to t2 subsequent to the first half period to t1, the driving current Ioled corresponding to the electric charge stored in the capacitor C flows in the organic EL element OLED, and the organic EL element OLED emits light. At the time t1, the scanning signal SEL falls to the L level, and the switching transistor T1 is turned off. Thus, the data voltage Vdata is not applied to one of the electrodes of the capacitor C, but, due to the electric charge stored in the capacitor C, a voltage equivalent to the gate voltage Vg is applied to the gate of the drive transistor T4.

In synchronization with the fall time of the scanning signal SEL at the time t1, the pulse signal PLS, which has been kept at the L level, changes to a signal with pulse waveform. This pulse waveform continues until the time t2 at which next selection of the pixel 2 starts. The conduction of the control transistor T5 is controlled in this way to thereby cause the current path for the driving current Ioled to be interrupted a plurality of times, and light emission and non-light-emission of the organic EL element OLED are therefore repeated.

As described above, in this embodiment, the conduction of the control transistor T5 is controlled to thereby repeat interruption of the current path for the driving current Ioled for the period t0 to t2 after the pixel 2 is selected until the next time it is selected. Thus, light emission and non-light-emission of the organic EL element OLED are carried out a plurality of times for the driving period t1 to t2. As a result, like the first embodiment, the optical response of the pixel 2 can be approximately an impulse response. Moreover, the non-light-emission time of the organic EL element OLED (the time of black display) can be dispersed in the period t1 to t2, thus reducing flickering of the displayed image. Therefore, the display quality can be improved. The optical response of the pixel 2 can also be suppressed, and a false contour in moving pictures can effectively removed.

The average brightness of light emission and non-light-emission by the organic EL element OLED is lower than that of continuous light emission. The balance between the light-emission time and the non-light-emission time can be controlled to readily perform brightness control with ease.

In this embodiment, conversion of the waveform of the pulse signal PLS to a pulse form may be started at the same time as the fall time t1 of the scanning signal SEL, or at an earlier time by predetermined time in view of, particularly, stability of low-grayscale data writing.

This embodiment relates to a pixel circuit structure for driving a voltage-programmed pixel circuit. In this embodiment, each horizontal line Y is formed of two scanning lines to which a first scanning signal and a second scanning signal are supplied, and a single signal line to which a pulse signal PLS is supplied.

Figure 14:
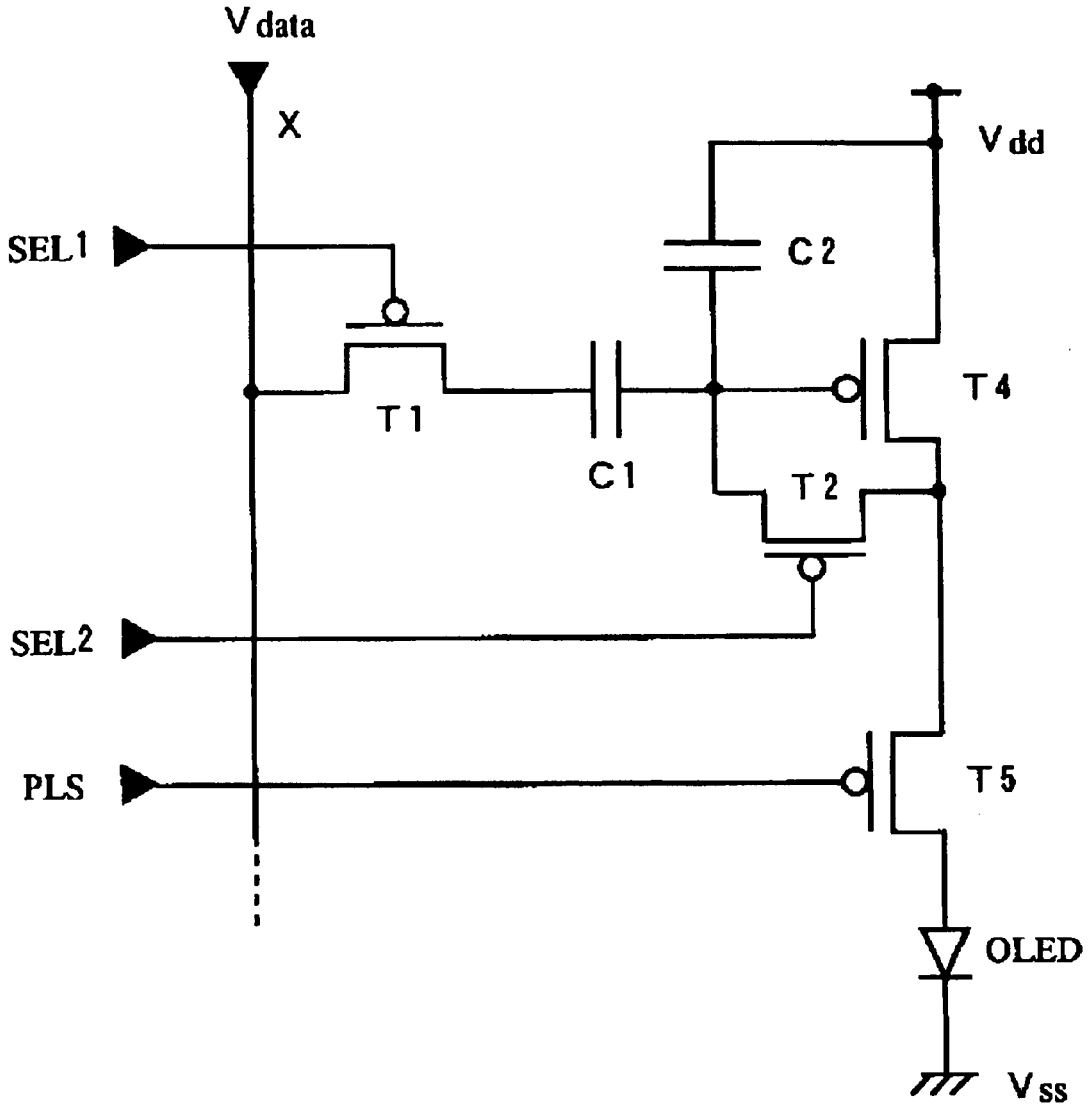
FIG. 14 is a circuit diagram of each pixel according to a fifth embodiment.

FIG. 14 is an exemplary circuit diagram of each pixel 2 according to this embodiment. Each pixel 2 is formed of an organic EL element OLED, four transistors T1, T2, T4, and T5, and two capacitors C1 and C2. In the pixel circuit according to this embodiment, the transistors T1, T2, T4, and T5 are p-channel transistors, however, this is merely an example, and it should be understood that the present invention is not limited thereto.

The first switching transistor T1 has a gate connected with a scanning line to which a scanning signal SEL is supplied, and a source connected with a data line X to which a data voltage Vdata is supplied. A drain of the first switching transistor T1 is connected with one electrode of the first capacitor C1. The other electrode of the first capacitor C1 is commonly connected with one electrode of the second capacitor C2, a source of the second switching transistor T2, and a gate of the drive transistor T4.

A power potential Vdd is applied to the other electrode of the second capacitor C2 and a source of the drive transistor T4. A second scanning signal SEL2 is supplied to a gate of the second switching transistor T2, and a drain of the second switching transistor T2 is commonly connected with a drain of the drive transistor T4 and a source of the control transistor T5. The control transistor T5 having a gate to which a pulse signal PLS is supplied is provided between the drain of the drive transistor T4 and an anode of the organic EL element OLED. A potential Vss is applied to a cathode of the organic EL element OLED.

Figure 15:
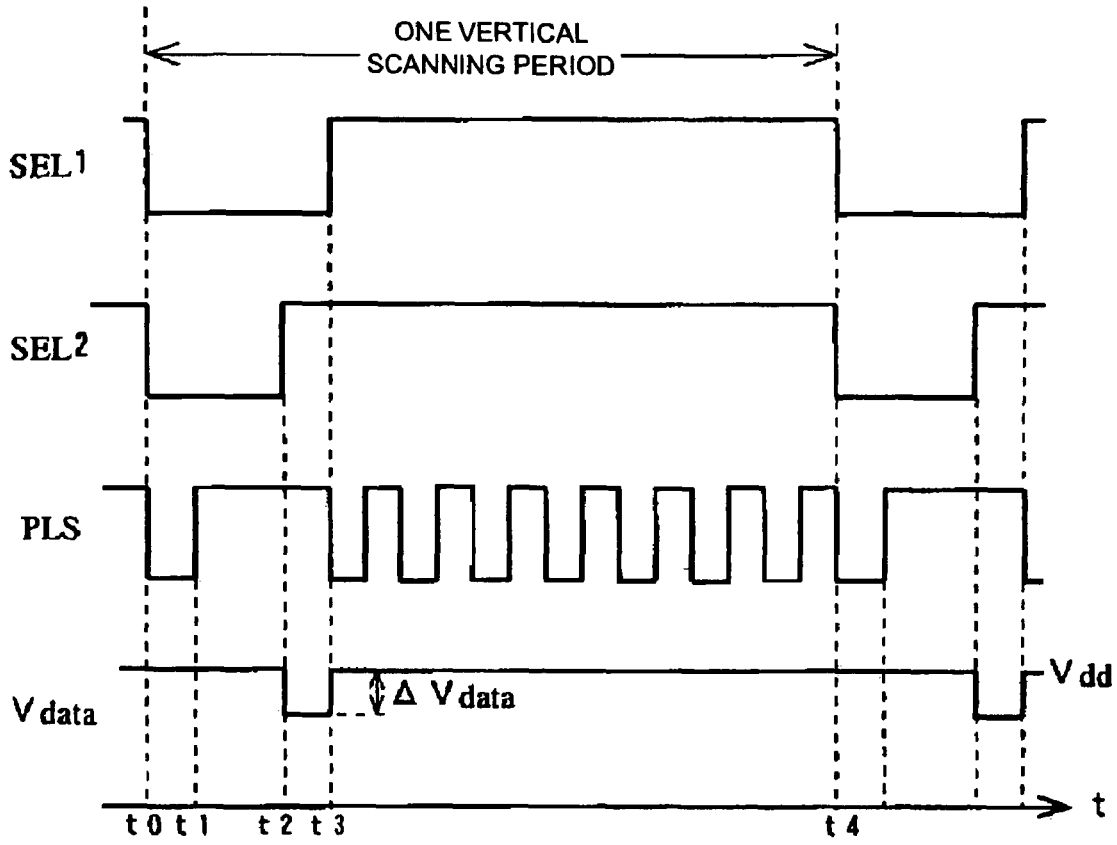
FIG. 15 is a drive timing chart of each pixel according to the fifth embodiment.

FIG. 15 is an exemplary drive timing chart of the pixel 2 according to this embodiment. One vertical scanning period t0 to t4 can be divided into a period t0 to t1, an auto-zero period t1 to t2, a data loading period t2 to t3, and a driving period t3 to t4.

First, in the period t0 to t1, the potential of the drain of the drive transistor T4 is set to the potential Vss. More specifically, at the time t0, the first and second scanning signals SELL and SEL2 fall to the L level, and the first and second switching transistors T1 and T2 are turned on. Since the power potential Vdd is constantly applied to the data line X for the period t0 to t1, the power potential Vdd is applied to one of the electrodes of the first capacitor C1. In the period to t1, the pulse signal PLS is maintained at the L level, and the control transistor T5 is turned on. Thus, a current path passing through the control transistor T5 and the organic EL element OLED is formed, and the drain potential of the drive transistor T4 becomes the potential Vss. Therefore, a gate voltage Vgs based on the source of the drive transistor T4 becomes negative, and the drive transistor T4 is turned on.

Then, in the auto-zero period t1 to t2, the gate voltage Vgs of the drive transistor T4 is equal to a threshold voltage Vth. In the period t1 to t2, the scanning signals SEL1 and SEL2 are still at the L level, and thereby the switching transistors T1 and T2 are still on. At the time t1, the pulse signal PLS rises to the H level, and the control transistor T5 is turned off, but the power potential Vdd is still applied to one of the electrodes of the first capacitor C1 from the data line. The power potential Vdd applied to the source of the drive transistor T4 is applied to the gate thereof via the channel thereof and the second switching transistor T2. This causes the gate voltage Vgs of the drive transistor T4 to be boosted to the threshold voltage Vth thereof, and the drive transistor T4 is turned off when the gate voltage Vgs reaches the threshold voltage Vth. As a result, the threshold voltage Vth is applied to the electrodes of the two capacitors C1 and C2 connected with the gate of the drive transistor T4. Meanwhile, the power potential Vdd from the data line X is applied to the opposite electrodes of the capacitors C1 and C2, and therefore the potential difference of each of the capacitors C 1 and C2 is set to the difference between the power potential Vdd and the threshold voltage Vth (Vdd−Vth) (auto zero).

In the subsequent data loading period t2 to t3, data is written to the capacitors C1 and C2 set to auto zero. In the period t2 to t3, the first scanning signal SEL1 is still maintained at the L level, and the pulse signal PLS is still maintained at the H level. Thus, the first switching transistor T1 is still on, and the control transistor T5 is still off. However, the second scanning signal SEL2 rises to the H level at the time t2, and therefore the second switching transistor T2 changes from the on state to the off state. As the data voltage Vdata, a voltage level equal to the previous power potential Vdd minus ΔVdata is applied to the data line X. The amount of change ΔVdata is variable depending upon the data to be written to the pixel 2. Therefore, the potential difference of the first capacitor C1 is reduced. As the potential difference of the first capacitor C1 changes, the potential difference of the second capacitor C2 also changes according to the capacitance division between the capacitors C1 and C2. The potential difference of each of the capacitors C1 and C2 after changing is determined by a value obtained by deducting the amount of change ΔVdata from the potential difference (Vdd−Vth) of each capacitor in the auto-zero period t1 to t2. Based on the change in the potential difference of the capacitors C1 and C2 depending upon the amount of change ΔVdata, data is written to the capacitors C1 and C2.

Finally, in the driving period t3 to t4, the driving current Ioled corresponding to the electric charge stored in the second capacitor C2 flows in the organic EL element OLED, and the organic EL element OLED emits light. At the time t3, the first scanning signal SEL1 rises to the H level, and the first switching transistor T1 changes from the on state to the off state (the second switching transistor T2 is still off). The voltage of the data line X recovers to the power potential Vdd. Thus, the data line X to which the data power potential Vdd is applied and one of the electrodes of the first capacitor C1 are separated from each other, and the gate and drain of the drive transistor T4 are also separated from each other. Therefore, a voltage (the gate voltage Vgs based on the source) corresponding to the electric charge stored in the second capacitor C2 is applied to the gate of the drive transistor T4. The equation to determine a current Ids (corresponding to the driving current Ioled) flowing in the drive transistor T4 includes the threshold voltage Vth and the gate voltage Vgs of the drive transistor T4 as variables. However, if the potential difference (corresponding to Vgs) of the second capacitor C2 is substituted for the gate voltage Vgs, the threshold voltage Vth is cancelled in the equation to determine the driving current Ioled. As a result, the driving current Ioled is not affected by the threshold voltage Vth of the drive transistor T4, but only depends upon the amount of change ΔVdata of the data voltage.

The current path for the driving current Ioled is a path formed from the power potential Vdd to the potential Vss via the drive transistor T4, the control transistor T5, and the organic EL element OLED. The driving current Ioled corresponds to the channel current of the drive transistor T4, and is controlled by the gate voltage Vgs related to the electric charge stored in the second capacitor C2. In the driving period t3 to t4, like the foregoing embodiments, the pulse signal PLS is converted to a signal with pulse form, and the control transistor T5 whose conduction is controlled by the signal PLS is alternately turned on and off. As a result, the current path for the driving current Ioled is repeatedly interrupted, and light emission and non-light-emission of the organic EL element OLED are alternately repeated.

As described above, in this embodiment, the control transistor T5 repeats interruption of the current path for the driving current Ioled for the driving period t3 to t4, and continues interruption of the current path for the driving current Ioled for the remaining period t0 to t3 except for the driving period t3 to t4. Thus, light emission and non-light-emission of the organic EL element OLED are carried out a plurality of times for the driving period t3 to t4. As a result, like the first embodiment, the optical response of the pixel 2 can be approximately an impulse response. Moreover, the non-light-emission time of the organic EL element OLED (the time of black display) can be dispersed in the period t1 to t2, thus reducing flickering of the displayed image. Therefore, the display quality can be further improved. The optical response of the pixel 2 can also be improved, and a false contour in moving pictures can effectively be suppressed.

The average brightness of light emission and non-light-emission by the organic EL element OLED is lower than that of continuous light emission. The balance between the light-emission time and the non-light-emission time can be controlled to thereby perform brightness control with ease. In this embodiment, the pulse waveform of the pulse signal PLS ends at the time t4, but may end at a time a predetermined time earlier than the time t4 in view of, particularly, stability of low-grayscale data writing.

The foregoing embodiments have been described in the context of the organic EL element OLED as an electro-optical element. However, the present invention is not limited thereto, and is applicable to any other electro-optical element which emits light with a brightness corresponding to the driving current.

The electro-optical device according to the foregoing embodiments may be installed in a variety of electronic apparatuses including, for example, a projector, a cellular phone, a portable terminal, a mobile computer, a personal computer, and so forth. If the above-described electro-optical device is installed in such electronic apparatuses, the commercial value of such electronic apparatuses can be increased, and the electronic apparatuses can have market appeal.

According to the present invention, therefore, each pixel having an electro-optical element for emitting light with a brightness corresponding to a driving current includes a control transistor, which is one form of control element, for interrupting a current path for the driving current. In a period after a scanning line corresponding to a given pixel is selected until the next time this scanning line is selected, the current path for the driving current is interrupted at a desirable timing by controlling the conduction of the control transistor. The display quality is therefore improved.

While this invention has been described in conjunction with specific embodiments thereof, it is evident that many alternatives, modifications and variations will be apparent to those skilled in the art. Accordingly, preferred embodiments of the invention as set forth herein are intended to be illustrative, not limiting. Various changes can be made without departing from the spirit and scope of the invention.

What is claimed is:

1. An electro-optical device, comprising:

a plurality of scanning lines;

a plurality of data lines;

a plurality of pixels located at intersections of the scanning lines and the data lines;

a scanning-line driving circuit that selects the scanning line corresponding to a pixel to which data showing display gradation is written and that outputs a pulse signal synchronous with the scanning signal; and a data-line driving circuit that cooperates with the scanning-line driving circuit and that outputs a data voltage to the data line corresponding to the pixel to which data is written, each of the pixels including:

a switching transistor that is connected to the data line, and is controlled by the scanning signal;

a capacitor that is coupled with the switching transistor, and stores an electric charge corresponding to the data voltage;

a drive transistor that sets a driving current according to the electric charge stored in the capacitor;

an electro-optical element that emits light with a brightness corresponding to the driving current; and a control transistor that repeatedly interrupts a current path for the driving current under conduction control according to the pulse signal synchronous with the scanning signal for a period after the scanning line corresponding to the pixel to which data is written is selected until the immediate next time this scanning line is selected.

2. The electro-optical device according to claim 1, the control transistor continuing to interrupt the current path of the driving current for a first half period of the period after the scanning line corresponding to the pixel to which data is written is selected until the next time this scanning line is selected, and repeatedly interrupting the current path of the driving current for a last half period subsequent to the first half period.

3. The electro-optical device according to claim 1, timing that begins interruption of a current path of the driving current according to the pulse signal is earlier than timing at which the switching transistor is placed in an off state by the scanning signal.

4. An electro-optical device, comprising:

a plurality of scanning lines;

a plurality of data lines;

a plurality of pixels located at intersections of the scanning lines and the data lines;

a scanning-line driving circuit that selects the scanning line corresponding to a pixel to which data showing display gradation is written and that outputs a second scanning signal synchronous with the first scanning signal and a pulse signal synchronous with the first scanning signal; and a data-line driving circuit that cooperates with the scanning-line driving circuit and that outputs a data voltage, of a size corresponding to display gradation, to the data line corresponding to the pixel to which data is written, each of the pixels including:

a first switching transistor having one of a source terminal and a drain terminal coupled with the data line so as to be controlled by the first scanning signal;

a first capacitor having one of its electrodes coupled with another terminal of the first switching transistor;

a second capacitor having a power source potential applied to one of its electrodes;

a second switching transistor having one of the source terminal and the drain terminal commonly coupled with the other electrode of the first capacitor and the other electrode of the second capacitor so as to be controlled by the second scanning signal;

a drive transistor having a gate commonly coupled with the other terminal of the second switching transistor, the other terminal of the first capacitor, and the other terminal of the second capacitor, the other electrode of the second capacitor being coupled with a source, the other terminal of the second switching transistor being coupled with a drain, an electric charge corresponding to the data voltage being stored in the second capacitor, and a driving current being set according to the electric charge stored in the second capacitor;

an electro-optical element that emits light with a brightness corresponding to the driving current; and a control transistor that repeatedly interrupts a current path for the driving current under conduction control according to the pulse signal so as to be synchronous with the first scanning signal for a period after the scanning line corresponding to the pixel to which data is written is selected until the immediate next time this scanning line is selected, after a voltage between a gate and a source of the drive transistor is adjusted by using capacitance coupling of the first and second capacitors.

5. The electro-optical device according to claim 4, the control transistor being under conduction control of the pulse signal output by the scanning-line drive circuit so as to be synchronous with the scanning signal supplied to the pixel to which data is written and placing the pulse signal to the pixel to which data is written in a pulse state in which low and high levels are alternately repeated.

6. The electro-optical device according to claim 4, the control transistor repeatedly interrupting a current path for the driving current under conduction control for a period after the scanning line corresponding to the pixel to which data is written is selected until the next time this scanning line is selected, and continuously interrupting a current path for the driving current for a period except the driving period.

7. The electro-optical device according to claim 4, the period except the driving period being further divided into a plurality of periods, and the voltage between the gate and source of the drive transistor being adjusted for a predetermined period that has been divided.

8. The electro-optical device according to claim 7, writing of the data beginning during the period except the driving period, after the voltage between the gate and source of the drive transistor has been adjusted.

9. The electro-optical device according to claim 8, adjustment of the voltage between the gate and the source of the drive transistor being performed by movement of electric charges stored in the first and second capacitors.

10. The electro-optical device according to claim 4, the repeating of the interruption of a current path of the driving current according to the pulse signal being completed earlier, by a predetermined time, than a point at which the scanning line is next selected.

11. The electro-optical device according to claim 1, transistors constituting the pixels being all of the same conductive type.

12. An electronic device, in which the electro-optical device as set forth in claim 1 is mounted.

13. A method of driving an electro-optical device having a plurality of pixels located at intersections of scanning lines and data lines, a scanning-line driving circuit that selects the scanning line corresponding to a pixel to which data showing display gradation is written, and a data-line driving circuit that outputs a data voltage to the data line corresponding to the pixel to which data is written, comprising:

a first step of outputting a data voltage to the data line corresponding to the pixel to which data is written;

a second step of writing data corresponding to the data voltage supplied to the data line to first and second capacitors of the pixel to which data is written;

a third step of setting a driving current according to an electric charge stored in the second capacitor and supplying the driving current to an electro-optical element by a drive transistor of the pixel to which data is written; and a fourth step of repeatedly interrupting a current path of the driving current, in synchronization with the scanning signal, for a period after the scanning line corresponding to the pixel to which data is written is selected until the immediate next time this scanning line is selected.

14. A method of driving the electro-optical device as set forth in claim 13, further comprising:

a fifth step of adjusting a voltage between the gate and the source of the drive transistor before performing the second step.

15. A method of driving the electro-optical device as set forth in claim 14, the repeating of the interruption of the current path of the driving current completing earlier, by a predetermined time, than a point at which the scanning line is selected the next time.

* * * * *